US012460345B2

(12) United States Patent
Choi et al.

(10) Patent No.: US 12,460,345 B2
(45) Date of Patent: Nov. 4, 2025

(54) LAUNDRY TREATING APPARATUS

(71) Applicant: LG ELECTRONICS INC., Seoul (KR)

(72) Inventors: Jeongryeol Choi, Seoul (KR); Junyoung Choi, Seoul (KR); Minhyoung Lee, Seoul (KR); Sunyong Kim, Seoul (KR); Hyunggyu Lim, Seoul (KR); Junyoung Nam, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 39 days.

(21) Appl. No.: 18/143,930

(22) Filed: May 5, 2023

(65) Prior Publication Data

US 2023/0272576 A1 Aug. 31, 2023

Related U.S. Application Data

(63) Continuation of application No. 17/402,495, filed on Aug. 13, 2021, now Pat. No. 11,680,362, which is a (Continued)

(30) Foreign Application Priority Data

Nov. 11, 2016 (KR) ..... 10-2016-0150163
Nov. 11, 2016 (KR) ..... 10-2016-0150164

(51) Int. Cl.
*D06F 73/02* (2006.01)
*D06F 58/10* (2006.01)
(Continued)

(52) U.S. Cl.
CPC ..... *D06F 73/02* (2013.01); *D06F 58/10* (2013.01); *D06F 71/40* (2013.01); *D06F 71/02* (2013.01)

(58) Field of Classification Search
None
See application file for complete search history.

(56) References Cited

U.S. PATENT DOCUMENTS 5,359,792 A * 11/1994 Hanada ..... D06F 71/29 38/66
2003/0019087 A1 1/2003 Pasin ..... A44B 99/00 24/545

(Continued)

FOREIGN PATENT DOCUMENTS

CN 2827739 Y 10/2006
CN 102414361 A 4/2012

(Continued)

*Primary Examiner* — Rita P Adhlakha
(74) *Attorney, Agent, or Firm* — Bryan Cave Leighton Paisner LLP

(57) ABSTRACT

A laundry treating apparatus is disclosed, which enables washing, drying, deodorization, sterilization and wrinkle removal. The laundry treating apparatus comprises a cabinet provided with a receiving space in which laundry is received; a supply unit for supplying at least one of the air and water into the receiving space; a presser provided in the receiving space to pressurize the laundry so as to remove a wrinkle of the laundry; and a clamp unit detachably pressurizing and fixing both ends of the laundry before pressurizing the laundry by using the presser.

12 Claims, 20 Drawing Sheets

Related U.S. Application Data continuation of application No. 15/809,106, filed on Nov. 10, 2017, now Pat. No. 11,111,624.

(51) Int. Cl.
*D06F 71/02* (2006.01)
*D06F 71/40* (2006.01)

(56) References Cited

U.S. PATENT DOCUMENTS

| | | | | |
|---|---|---|---|---|
| 2010/0282785 | A1 | 11/2010 | Roselle et al. | |
| 2014/0223973 | A1 | 8/2014 | Alrefaei | D06F 73/00 68/5 B |
| 2015/0020419 | A1 | 1/2015 | Park | D06F 67/005 38/3 |
| 2015/0159315 | A1* | 6/2015 | Lim | D06F 71/36 38/3 |
| 2016/0208429 | A1 | 7/2016 | Park et al. | |

FOREIGN PATENT DOCUMENTS

| | | | |
|---|---|---|---|
| CN | 104294529 | A | 1/2015 |
| CN | 104695195 | A | 6/2015 |
| EP | 0324589 | A1 | 7/1989 |
| EP | 2826911 | A1 | 1/2015 |
| EP | 2889426 | A1 | 7/2015 |
| JP | S47-020008 | Y | 7/1972 |
| JP | 05-068795 | A | 3/1993 |
| JP | 5-96092 | A | 4/1993 |
| JP | 10-235096 | A | 9/1998 |
| JP | 10314500 | A | 12/1998 |
| JP | 11-5000 | A | 1/1999 |
| KR | 10-2011-0048343 | A | 5/2011 |
| KR | 10-1312979 | A | 2/2012 |
| KR | 10-2012-0091799 | A | 8/2012 |
| KR | 1020130017029 | A | 2/2013 |
| KR | 10-2015-0009718 | A | 1/2015 |
| WO | 2004/057089 | A1 | 7/2004 |

* cited by examiner

LAUNDRY TREATING APPARATUS

This application is a continuation of U.S. patent application Ser. No. 17/402,495, filed Aug. 13, 2021, which is a continuation of U.S. patent application Ser. No. 15/809,106, filed on Nov. 10, 2017 (now U.S. Pat. No. 11,111,624 issued on Aug. 18, 2021), which claims the benefit of earlier filing date and right of priority to Korean Patent Application No. 10-2016-0150163, filed on Nov. 11, 2016 and Korean Patent Application No. 10-2016-0150164, filed on Nov. 11, 2016, the contents of which are each hereby incorporated by reference as if fully set forth herein.

BACKGROUND OF THE INVENTION

Field of the Invention

The present invention relates to a laundry treating apparatus.

Discussion of the Related Art

Generally, a laundry treating apparatus includes a washing machine for washing, rinsing and drying laundry, a dryer for drying wet laundry, and a refresher for removing a laundry-soaked smell or a wrinkle.

The laundry treating apparatus of the related art performs washing, drying and refreshing by putting laundry into a drum which is being rotated. However, problems occur in that a user cannot wear laundry, which is taken out of the drum, immediately due to much wrinkle, frequent washing using washing water may cause a damage of laundry, and big energy consumption is caused because a motor should be driven to rotate the drum.

To solve the problems, a laundry treating apparatus, from which a tub for storing washing water or a rotating drum is removed, for supplying steam or hot air to perform washing, drying and refreshing in a state that laundry is held, has been launched. The laundry treating apparatus may include a presser for pressing a crease already formed on laundry and removing a wrinkle generated due to usage of laundry.

However, the presser of the related art has a problem in that another crease is generated as laundry is pressurized to remove a wrinkle generated thereon, whereby double creases are generated on the laundry.

SUMMARY OF THE INVENTION

Accordingly, the present invention is directed to a laundry treating apparatus that substantially obviates one or more problems due to limitation and disadvantages of the related art.

An object of the present invention is to provide a laundry treating apparatus that enables washing, drying, deodorization, sterilization and wrinkle removal.

Another object of the present invention is to provide a laundry treating apparatus that removes a wrinkle generated on laundry and compresses the laundry to make a crease of the laundry be clear.

Other object of the present invention is to provide a laundry treating apparatus that compresses laundry so as not to generate another crease in addition to a crease already formed on the laundry.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, a laundry treating apparatus comprises a cabinet provided with a receiving space in which laundry is received; a supply unit for supplying at least one of the air and water into the receiving space; a presser provided in the receiving space to pressurize the laundry so as to remove a wrinkle of the laundry; and a clamp unit detachably pressurizing and fixing both ends of the laundry before pressurizing the laundry by using the presser.

In the present invention according to one embodiment, the clamp unit pressurizes and fixes both ends of the laundry so as not to pressurize a sewing line provided at a center of the laundry.

In the present invention according to one embodiment, the clamp unit is provided below the presser.

In the present invention according to one embodiment, the clamp unit includes a first support unit provided to be fixed into the receiving space, supporting the laundry; a first left clip provided at a left end of the first support unit, pressurizing and fixing a left end of the laundry together with the first support unit; and a first right clip provided at a right end of the first support unit, pressurizing and fixing a right end of the laundry together with the first support unit.

In the present invention according to one embodiment, a center of the first support unit is fixed into the receiving space, and both ends of the first support unit are provided as free ends having an elastic force.

In the present invention according to another embodiment, the clamp unit includes a second left clip provided to be fixed to the receiving space, fixing the left end of the laundry and a second right clip provided to be fixed to the receiving space, fixing the right end of the laundry, the second left clip includes a second left clip support unit supporting the left end of the laundry, and a second left clip pressurizer rotatably provided to be spaced apart from the second left clip support unit and rotated in an insertion direction of the laundry during insertion of the laundry between the second left clip support unit and the second left clip pressurizer to store an elastic force, pressurizing the laundry by acting the stored elastic force as a restoring force, and the second right clip includes a second right clip support unit supporting the right end of the laundry, and a second right clip pressurizer rotatably provided to be spaced apart from the second right clip support unit and rotated in an insertion direction of the laundry during insertion of the laundry between the second right clip support unit and the second right clip pressurizer to store an elastic force, pressurizing the laundry by acting the stored elastic force as a restoring force.

In the present invention according to another embodiment, the first left clip includes a second left clip grip extended from the second left clip pressurizer to rotate the second left clip pressurizer in an insertion direction of the laundry inserted between the second left clip support unit and the second left clip pressurizer, and the first right clip includes a second right clip grip extended from the second right clip pressurizer to rotate the second right clip pressurizer in an insertion direction of the laundry inserted between the second right clip support unit and the second right clip pressurizer.

In the present invention according to another embodiment, the second left clip includes a damper of a rubber material on at least one surface of the second left clip support unit and the second left clip pressurizer to fix the laundry inserted between the second left clip support unit and the second left clip pressurizer, and the second right clip includes a damper of a rubber material on at least one surface of the second right clip support unit and the second right clip pressurizer to fix the laundry inserted between the second right clip support unit and the second right clip pressurizer.

In the present invention according to another embodiment, the second left clip includes an inclined portion, which increases an interval between the second left clip support unit and the second left clip pressurizer, on at least one surface of the second left clip support unit and the second left clip pressurizer to easily insert the laundry between the second left clip support unit and the second left clip pressurizer, and the second right clip includes an inclined portion, which increases an interval between the second right clip support unit and the second right clip pressurizer, on at least one surface of the second right clip support unit and the second right clip pressurizer to easily insert the laundry between the second right clip support unit and the second right clip pressurizer.

In the present invention according to another embodiment, the clamp unit includes a left folder rotatably provided in the receiving space to fix the left end of the laundry, and a right folder rotatably provided in the receiving space to fix the right end of the laundry.

Also, to achieve the objects, the present invention provides a laundry treating apparatus comprising a cabinet provided with a receiving space in which laundry is received; a supply unit for supplying at least one of the air and water into the receiving space; a presser pressurizing the laundry so as to remove a wrinkle of the laundry; and a clamp unit fixing the laundry before pressurizing the laundry by using the presser, wherein the clamp unit includes a compression unit pressurizing the laundry; and a link connected to the compression unit and rotatably connected to the inside of the receiving space by a rotation unit.

In the present invention, the compression unit has a bar shape.

In the present invention, the rotation unit is provided such that a center of rotation is movable.

In the present invention, the rotation unit includes a closing protrusion protruded from the link; an opening protrusion spaced apart from the closing protrusion to be far away from an end of the link and protruded from the link; and a guide groove guiding the closing protrusion and the opening protrusion.

In the present invention, the guide groove includes a first guide groove far away from the laundry toward an upper side.

In the present invention, the compression unit is provided to pressurize the laundry if the closing protrusion reaches a lower end of the first guide groove.

In the present invention, the guide groove further includes a second guide groove connected from the lower end of the first guide groove and far away from the laundry toward a lower side.

In the present invention, the second guide groove is provided to be shorter than a length of the first guide groove.

In the present invention, the guide groove further includes a third guide groove connected from an upper end of the first guide groove and formed to be far away from the laundry.

In the present invention, the third guide groove has an end provided between virtual horizontal lines of an upper end and a lower end of the first guide groove.

In the present invention, the laundry treating apparatus further comprises a protrusion provided in the receiving space to support the laundry pressurized by the compression unit, wherein the protrusion includes a protrusion inclined portion close to the laundry toward a lower side.

According to the present invention, a laundry treating apparatus may be provided, which enables washing, drying, deodorization, sterilization and wrinkle removal.

Also, according to the present invention, a laundry treating apparatus may be provided, which removes a wrinkle generated on laundry and compresses the laundry to make a crease of the laundry be clear.

Also, according to the present invention, a laundry treating apparatus may be provided, which compresses laundry so as not to generate another crease in addition to a crease already formed on the laundry.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE INVENTION

Reference will now be made in detail to the preferred embodiments of the present invention, examples of which are illustrated in the accompanying drawings. Meanwhile, elements or control method of apparatuses which will be described below are only intended to describe the embodiments of the present invention and are not intended to restrict the scope of the present invention. Wherever possible, the same reference numbers will be used throughout the drawings to refer to the same or like parts.

Figure 1:
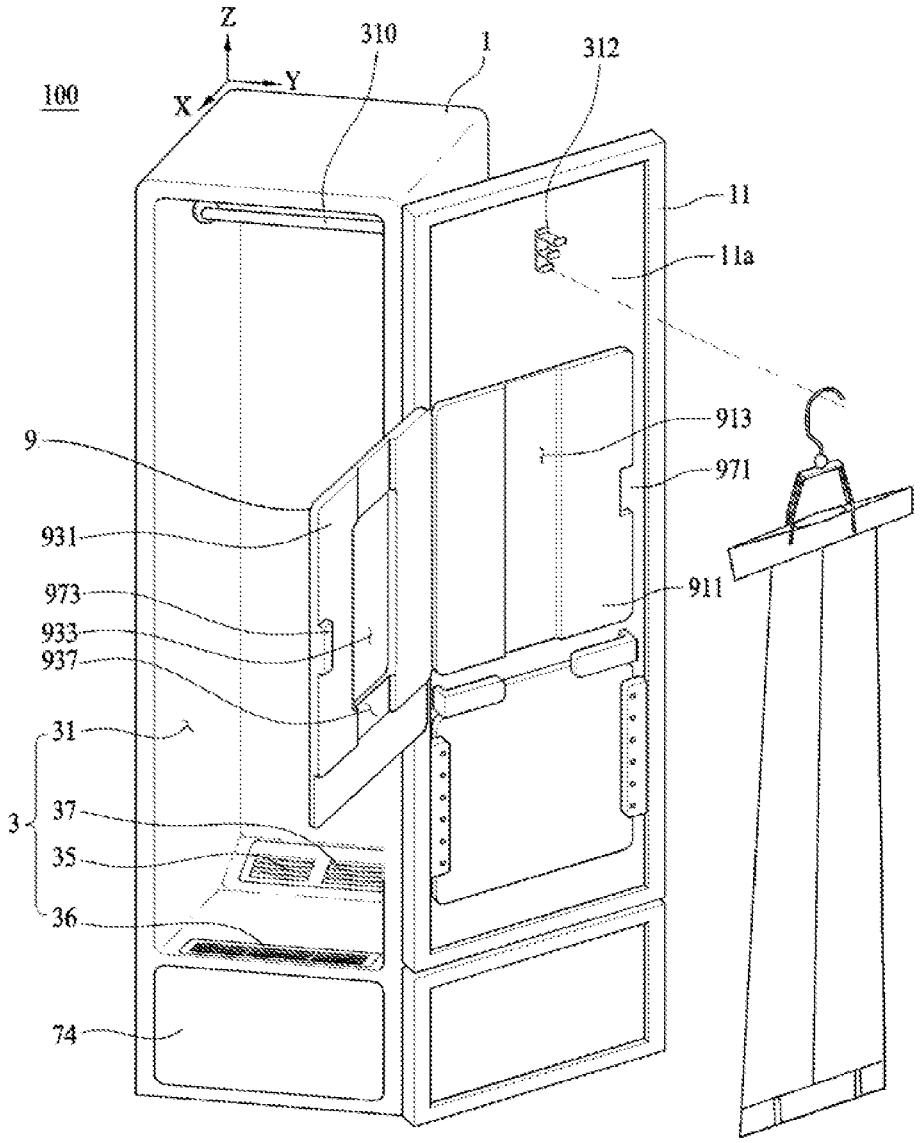
FIG. 1 is a view illustrating a laundry treating apparatus according to one embodiment of the present invention.

FIG. 1 is a view illustrating a laundry treating apparatus according to one embodiment of the present invention.

Hereinafter, a laundry treating apparatus according to one embodiment of the present invention will be described with reference to FIG. 1.

The laundry treating apparatus 100 according to one embodiment of the present invention may include a cabinet 1, a laundry receiving unit 3 provided inside the cabinet 1 to receive laundry therein, a door 11 rotatably connected to the cabinet 1 to open or close a receiving space 31, and a laundry support unit provided in the receiving space 31 to support laundry.

The cabinet 1 may form an external appearance of the laundry treating apparatus 100, and may have a rectangular shape.

The laundry receiving unit 3 may include the receiving space 31 arranged inside the cabinet 1, providing a space where laundry is received.

The laundry support unit may include at least one of a first laundry support unit 310 provided inside the receiving space 31 and a second laundry support unit 312 provided in the door 11.

The first laundry support unit 310 may be provided in a bar shape provided along a width direction (width direction of the door, Y-axis direction) of the receiving space 31.

The second laundry support unit 312 may be provided at an inner side 11*a* of the door 11 such that laundry is arranged inside the receiving space 31 in a state that the laundry is unfolded.

Figure 2:
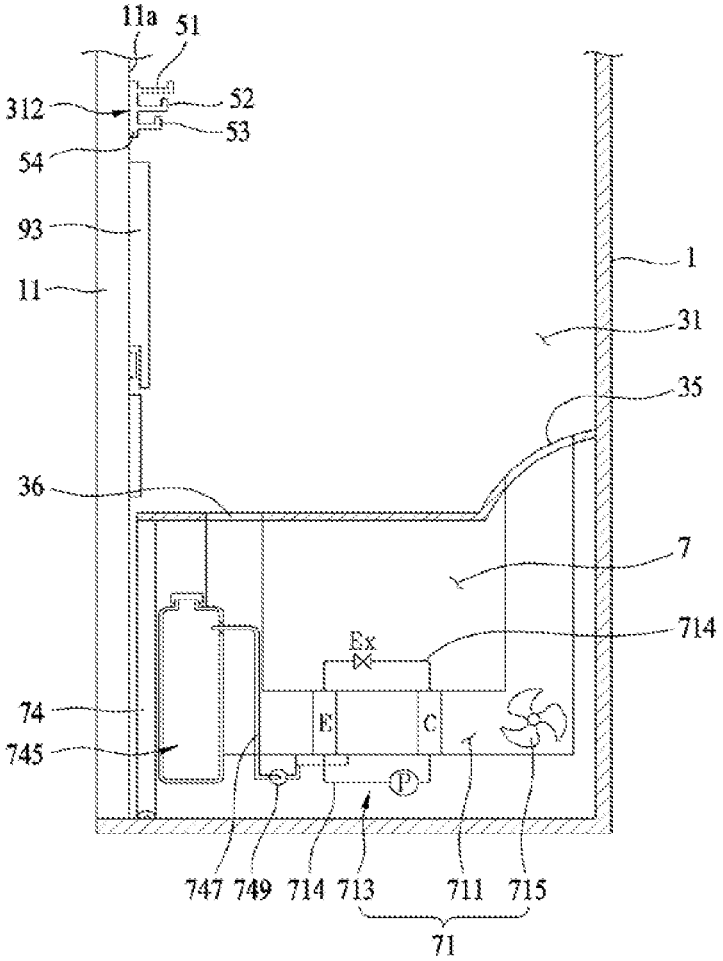
FIGS. 2 and 3 are views illustrating a section of a laundry treating apparatus according to one embodiment of the present invention.
Figure 3:
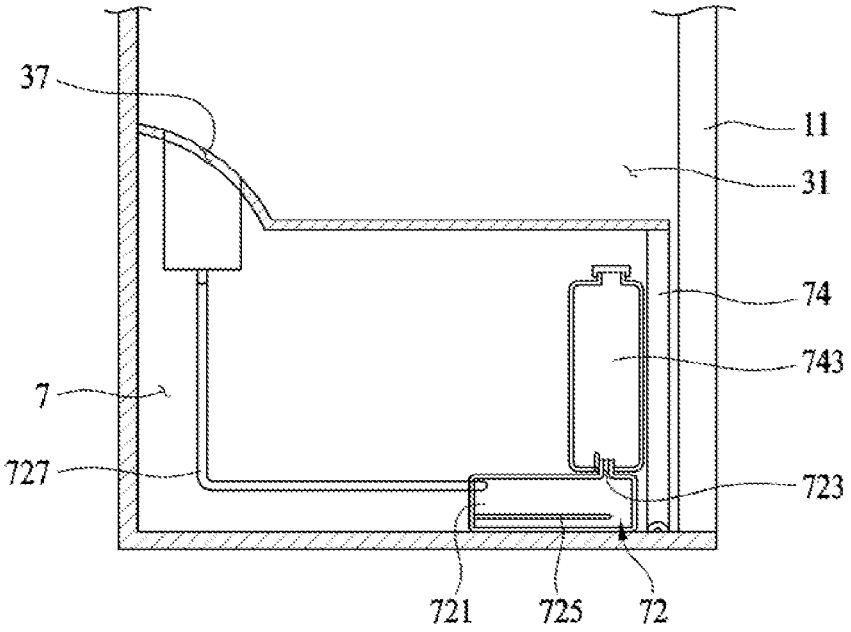

FIGS. 2 and 3 are views illustrating a section of a laundry treating apparatus according to one embodiment of the present invention.

Referring to FIG. 2, the second laundry support unit 312 may include a base 54 fixed to the door 11, and at least one or more support units 51, 52 and 53 provided to be protruded from the base 54 and arranged along a height direction (Z-axis direction) of the door 11.

The laundry treating apparatus 100 according to one example may include a machine room 7 detached from the receiving space 31 inside the cabinet 1, and a supply unit provided inside the machine room 7, supporting at least one of the air and water to the laundry receiving unit.

The machine room 7 may be arranged below the receiving space 31.

The air supplied to the receiving space 31 by the supply unit may be the heated air (hot air), and the water supplied to the receiving space by the supply unit may be steam.

The supply unit may include at least one of an air supply unit 71 supplying the air (heated air or non-heated air), and a water supply unit 72 supplying steam (or mist) to the receiving space 31.

Hereinafter, for convenience of description, the supply unit includes both the air supply unit 71 and the water supply unit 72, wherein the air supply unit 71 supplies the hot air to the receiving space 31, and the water supply unit 72 supplies steam to the receiving space 31.

The air supply unit 71 may include a circulation duct 711 for circulating the air inside the receiving space 31, and a heat exchanger 713 for exchanging the heat with the air moving along the circulation duct 711, and a blower 715 allowing the air inside the receiving space 31 to move along the circulation duct 711.

The circulation duct 711 is communicated with the inside of the receiving space 31 through an air vent 35 and an air inlet 36, and the air inside the receiving space is circulated in the order of the air inlet, the circulation duct, the air vent, and the receiving space.

The air vent 35 and the air inlet 36 provided to pass through the bottom of the receiving space 31. One end of the circulation duct 711 provided inside the machine room 7 is connected to the air inlet 36, and the other end of the circulation duct 711 is connected to the air vent 35.

The heat exchanger 713 may be provided as a heat pump for dehumidification and heating of the air entering the circulation duct 711. However, the heat exchanger 713 provided in the laundry treating apparatus of the present invention is not limited to the heat pump.

The heat exchanger 713 may include an evaporator E provided in the circulation duct 711, a condenser C arranged inside the circulation duct 711, a compressor P arranged outside the circulation duct, and an expander Ex. The evaporator E, the compressor P, the condenser C and the expander Ex are connected with one another through a refrigerant pipe 714.

The compressor P is a means for compressing a refrigerant at a high pressure to allow the refrigerant to circulate along the refrigerant pipe 714. The evaporator E is a means for evaporating the refrigerant by absorbing heat from the air inside the circulation duct 711. The condenser C is a means for condensing the refrigerant by discharging heat with the air inside the circulation duct 711.

The blower 715 is a means arranged inside the circulation duct 711 to circulate the air inside the receiving space 31 through the circulation duct 711, and may be arranged between the condenser C and the air vent 35.

If the blower 715 is operated, the air inside the circulation duct 711 moves to the receiving space 31 through the air vent 35 while the air inside the receiving space 31 moves to the circulation duct 711 through the air inlet 36.

The air entering the circulation duct 711 through the air inlet 36 is cooled while passing through the evaporator E, and the air passed through the evaporator is heated while passing through the condenser C.

If the air is cooled while passing through the evaporator E, water contained in the air is removed (dehumidified), and the water (condensed water) removed from the air remains on the surface of the evaporator or in the circulation duct.

The laundry treating apparatus 100 may include a drainage unit for removing the condensed water generated by the evaporator E. The drainage unit prevents heat exchange efficiency of the heat exchanger 713 from being deteriorated due to the condensed water remaining in the circulation duct 711.

The drainage unit may include a drainage tank 745 detachably provided in a machine room door 74, and a drainage pipe 747 and a drainage pump 749, which supply the condensed water inside the circulation duct 711 to the drainage tank 745.

Meanwhile, as shown in FIG. 3, the water supply unit 72 may include a storage unit 721 provided in the machine room 7, a heater 725 provided in the storage unit 721, and a water supply pipe 727 connecting the storage unit 721 to a water discharge unit 37.

The storage unit 721 is a means for storing water therein, and the heater 725 is a means for converting water stored in the storage unit 721 to steam by heating the water stored in the storage unit 721. The water supply pipe 727 is a means for guiding the steam inside the storage unit 721 to the receiving space 31.

The storage unit 721 is supplied with water through a water supply unit that may be provided as a water supply tank 743 detachably provided in the machine room door 74.

The storage unit 721 may further include a connection pipe 723 connected to the water supply tank 743 if the machine room door 74 closes the machine room 7 and detached from the water supply tank 743 if the machine room door 74 opens the machine room 7.

The water supply tank 743 is detachably provided in the machine room door 74 considering that the laundry treating apparatus 100 of the present invention is provided at a place far away from a water supply source (not shown).

In the present invention, since the hot air and steam are supplied to laundry in a state that the laundry is straightly unfolded inside the receiving space 31, a wrinkle may be prevented from being generated on the laundry after the steam or hot air is completely supplied to the laundry.

Meanwhile, as shown in FIG. 1, the laundry treating apparatus according to one example may include a presser 9 for removing a wrinkle generated on laundry or making a crease previously set on the laundry be clear.

The presser 9 may remove a wrinkle generated on the laundry by using the steam and hot air supplied to the receiving space 31 or fix the crease previously set on the laundry.

The presser 9 may be provided anywhere inside the receiving space 31, and is provided on the inner side 11*a* of the door 11 in FIG. 1.

The presser 9 may include a support unit 91 provided on an inner circumference of the door 11, providing a space (support space) through which laundry is supported, and a compression unit 93 rotatably provided in the support unit 91 or the door 11, compressing the laundry arranged in the support unit 91.

The support unit 91 may be provided as a surface of the door 11 headed for the receiving space 31, or may be provided as a separate member fixed to the surface of the door 11. As an example, FIG. 1 illustrates that the support unit 91 is provided as a separate body 911 fixed to the surface of the door 11.

The compression unit 93 may include a compression body 931 rotatably provided on the inner circumference of the door 11 or in the support body 911, and a body through hole 933 provided to pass through the compression body 931, supplying stream or hot air entering the receiving space 31 to the laundry held in the support body 911.

One end of the compression body 931 may rotatably be coupled to the door 11 or the support body 911, and the other end (free end) of the compression body 931 may detachably be coupled to the door 11 or the support body 911.

The compression body 931 may detachably provided on the inner circumference of the door 11 by joints 971 and 973. The joints may be provided as a detachable groove 971 provided in any one of the door 11 and the compression body 931 and a joint protrusion 973 provided in the other one of the door 11 and the compression body 931 and coupled to the detachable groove 971.

A hook H of a hanger 200 is held in the second laundry support unit 5 such that laundry such as pants may be held on the surface of the support body 911 in a state that the laundry is unfolded. If the laundry is held on the surface of the support body 911, a user couples the compression body 931 with the support body 911 through the joints 971 and 973 by rotating the compression body 931 in a direction of the support body 911. If the laundry is maintained in the compressed state between the support body 911 and the compression body 931, if the air supply unit 71 or the water supply unit 72 supplies the hot air or steam into the receiving space 31, the hot air or steam inside the receiving space 31 is supplied to the laundry through the body through hole 933. In this case, a wrinkle generated on the laundry may be removed and a crease previously set on the laundry may be clear.

Meanwhile, a sewing line exist in the laundry such as pants. If the presser 9 is provided by the aforementioned structure only, an unnecessary crease may be formed on the laundry by the sewing line.

To avoid the unnecessary crease, the presser 9 may further include grooves 913 and 935 provided in at least one of support body 911 and the compression body 931, allowing some area of the laundry such as the sewing line not to be compressed.

As an example, FIG. 1 illustrates that the grooves are provided as a support body groove 913 provided in the support body 911 and a compression body groove 937 provided in the compression body 931.

The support body groove 913 may be provided along a height direction (Z-axis direction) of the door, wherein the surface of the support body 911 may be bent to be concave. The support body groove 913 may be provided such that the surface of the support body 911 may be bent to be concave to be far away from the receiving space 31.

The compression body groove 937 may be provided such that the surface of the compression body 931 is bent to be concave to be far away (receiving space 31) from the support body 911 along the height direction (Z-axis direction) of the door 11.

The support body groove 913 may be arranged at the center of the support body 911, and the compression body groove 937 may be arranged at the center of the compression body 931.

The user arranges the sewing line provided in the laundry in the support body groove 913 or the compression body groove 937 and then rotates the compression body 931 in a direction of the support body 911 to pressurize the laundry by coupling the compression body 931 to the support body 911. In this procedure, a problem occurs in that the position of the laundry is changed or the shape of the laundry is changed to cause an unnecessary crease in the laundry.

To solve the problem, the laundry treating apparatus according to one embodiment of the present invention may include clamp units 6100, 6300 and 6500 for fixing the laundry before pressuring the laundry arranged in the support body 911 by using the compression body 931.

The user may arrange the sewing line of the laundry in the support body groove 913, align a crease previously set on the laundry and then fix the position of the laundry through the clamp units 6100, 6300 and 6500. Therefore, the possibility of detaching the sewing line of the laundry from the support body groove 913 during coupling of the compression body 931 to the support body 911 or generating a double crease in the laundry may be minimized.

The clamp units 6100, 6300 and 6500 may detachably pressurize and fix both ends of the laundry before the laundry is pressed by the presser 9.

The clamp units 6100, 6300 and 6500 may pressurize only both ends of the laundry so as not to pressurize the sewing line provided in the center of the laundry.

The clamp units 6100, 6300 and 6500 maybe provided below the presser 9.

If the presser 9 is provided on the inner side 11*a* of the door 11, the clamp units may be provided below the presser 9 at the inner side 11*a* of the door 11.

Also, in one example, if the presser 9 is provided on the inner side of the receiving space 31, the clamp units 6100, 6300 and 6500 may be provided below the presser 9 at the inner side of the receiving space 31.

Also, in one example, the presser 9 may be provided to be held in the laundry support unit. In this case, the clamp units 6100, 6300 and 6500 may be provided in the presser, specifically provided below the support body.

Figure 4:
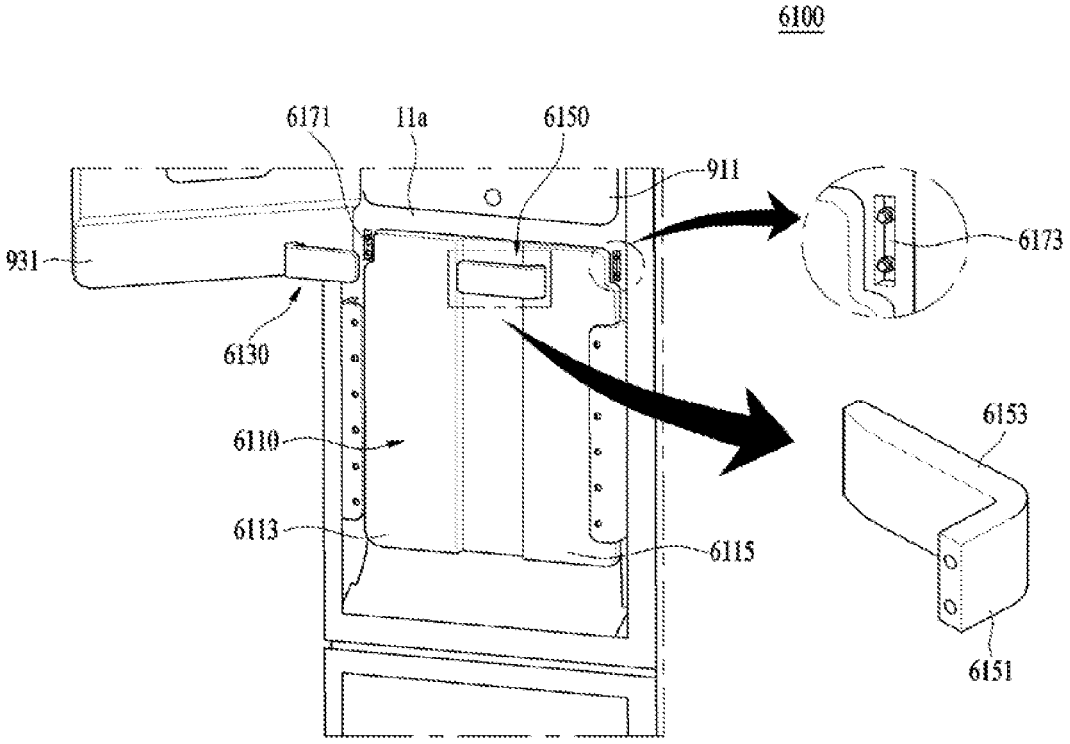
FIG. 4 is a view illustrating a clamp unit 6100 according to the first embodiment of the present invention.
Figure 5:
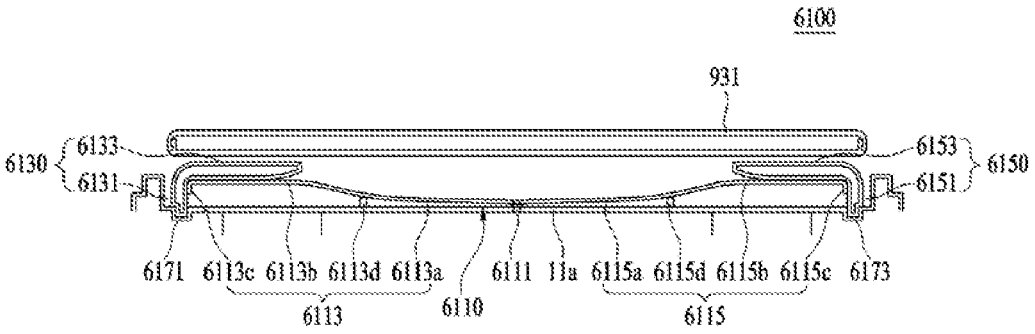
FIG. 5 is a view illustrating a section of a clamp unit 6100 according to the first embodiment of the present invention.

FIG. 4 is a view illustrating a clamp unit 6100 according to the first embodiment of the present invention. FIG. 5 is a view illustrating a section of a clamp unit 6100 according to the first embodiment of the present invention.

Referring to FIG. 4, the clamp unit 6100 according to the first embodiment may include a first support unit 6110 provided to be fixed into the receiving space, supporting laundry, a first left clip 6130 provided at a left end of the first support unit 6110, pressurizing and fixing a left end of the laundry together with the first support unit 6110, and a first right clip 6150 provided at a right end of the first support unit 6110, pressurizing and fixing a right end of the laundry together with the first support unit 6110.

The first support unit 6110 may be provided below the support body 911, or may be provided to be extended from the support body 911 to the lower side. FIG. 4 illustrates that the first support unit 6110 is configured as a separate member from the support body 911.

Preferably, a height direction (Z-axis direction) length of the first support unit 6110 of the laundry treating apparatus is longer than a height direction (Z-axis direction) of the first left clip and the first right clip.

The first support unit 6110 may be formed of an elastic material to have an elastic force. For example, the first support unit 6110 may be made of plastic or metal having flexibility.

Referring to FIG. 5, the center of the first support unit 610 may be fixed into the receiving space 31, and both ends of the first support unit 6110 may be provided as free ends having an elastic force.

The first support unit 6110 has a center 6111 fixed to the inner side 11*a* of the door by a clamp member (not shown), and may include a first left wing 6113 extended from the center of the first support unit 6110 to a left side and a first right wing 6115 extended from the center of the first support unit 6110 to a right side.

The first left wing 6113 may include a first left wing inclined portion 6113*a* extended from the center of the first support unit to be inclined toward the laundry, and a first left wing pressurizer 6113*b* connected to the first left wing inclined portion, respectively pressurizing both sides of the laundry together with the first left clip 6130.

The first left wing inclined portion 6113*a* may be provided to be spaced apart from the inner side 11*a* of the door if it is far away from the center. Also, the first left wing pressurizer 6113*b* may be provided at a predetermined interval from the inner circumference of the door.

The first left wing 6113 may further include a first left wing extension portion 6113*c* extended from an end of the first left wing pressurizer 6113*b* to the inner side 11*a* of the door. An end of the first left wing extension portion 6113*c* is provided to be spaced apart from the inner side 11*a* of the door.

If the laundry is inserted between the first left wing pressurizer 6113*b* and the first left clip 6130, the first left wing pressurizer 6113*b* moves to the door by means of an external force, and the first left wing extension portion 6113*c* may serve as a stopper that limits a moving distance of the first left wing pressurizer 6113*b* to the door.

Meanwhile, the first left wing 6113 may further include a first left wing protrusion 6113*d* extended from the first left wing inclined portion 6113*a* to the door or extended from the inner side 11*a* of the door to the first left wing inclined portion 6113*a*.

The first left wing protrusion 6113*d* spaces the first left wing inclined portion 6113*a* from the inner side 11*a* of the door. If an external force acts on the first left wing pressuring portion 6113*b*, the first left wing protrusion 6113*d* may become a rotation center of the first left wing pressurizer 6113*b* and therefore provide an elastic restoring force to the first left wing pressurizer 6113*b*.

The first right wing 6115 may include a first right wing inclined portion 6115*a* extended from the center of the first support unit to be inclined toward the laundry, and a first right wing pressurizer 6115*b* connected to the first right wing inclined portion, respectively pressurizing both sides of the laundry together with the first right clip 6150.

The first right wing inclined portion 6115*a* may be provided to be spaced apart from the inner side 11*a* of the door if it is far away from the center. Also, the first right wing pressurizer 6115*b* may be provided at a predetermined interval from the inner circumference of the door.

The first right wing 6115 may further include a first right wing extension portion 6115*c* extended from an end of the first right wing pressurizer 6115*b* to the inner side 11*a* of the door. An end of the first right wing extension portion 6115*c* is provided to be spaced apart from the inner side 11*a* of the door.

If the laundry is inserted between the first right wing pressurizer 6115*b* and the first right clip 6150, the first right wing pressurizer 6115*b* moves to the door by means of an external force, and the first right wing extension portion 6115*c* may serve as a stopper that limits a moving distance of the first right wing pressurizer 6115*b* to the door.

Meanwhile, the first right wing 6115 may further include a first right wing protrusion 6115*d* extended from the first right wing inclined portion 6115*a* to the door or extended from the inner side 11*a* of the door to the first right wing inclined portion 6115*a*.

The first right wing protrusion 6115*d* spaces the first right wing inclined portion 6115*a* from the inner side 11*a* of the door. If an external force acts on the first right wing pressuring portion 6115*b*, the first right wing protrusion 6115*d* may become a rotation center of the first right wing pressurizer 6115*b* and therefore provide an elastic restoring force to the first right wing pressurizer 6115*b*.

The first left clip 6130 and the first right clip 6150 may be provided to face each other, and may be provided at the same height.

The first left clip 6130 is provided at a left end of the first support unit, and respectively pressurizes and fixes front and rear sides of the left end of the laundry together with the first left wing pressurizer 6113*b*.

The first left clip 6130 is provided to be fixed to the inner side 11*a* of the door, and is provided to be lower than the support body 911. Therefore, the position and shape of the laundry pressurized by the support body and the compression body may be fixed.

The first left clip 6130 may include a first left clip joint 6131 fastened to the inner side 11*a* of the door, and a first left clip pressurizer 6133 extended from the first left clip joint to be bent toward the center 6111 of the first support unit.

The first left clip joint 6131 may be inserted into and fastened to a first left joint hole 6171 provided in the inner side 11*a* of the door.

The first left clip pressurizer 6133 may pressurize and fix both sides of the left end of the laundry together with the first left wing pressurizer 6113*b*. A left and right length of the first left clip pressurizer 6133 may be provided to be shorter than that of the first left wing 6113.

The first left wing protrusion 6113*d* may be provided between the end of the first left clip pressurizer 6133 and the center 6111 of the first support unit. Therefore, it is preferable to allow the sewing line of the laundry not to be pressurized by the first support unit and the first left clip.

The first right clip 6150 is provided at a right end of the first support unit, and respectively pressurizes and fixes front and rear sides of the right end of the laundry together with the first right wing pressurizer 6115*b*.

The first right clip 6150 is provided to be fixed to the inner side 11*a* of the door, and is provided to be lower than the support body 911. Therefore, the position and shape of the laundry pressurized by the support body and the compression body may be fixed.

The first right clip 6150 may include a first right clip joint 6151 fastened to the inner side 11*a* of the door, and a first right clip pressurizer 6153 extended from the first right clip joint to be bent toward the center 6111 of the first support unit.

The first right clip joint 6151 may be inserted into and fastened to a first right joint hole 6171 provided in the inner side 11*a* of the door.

The first right clip pressurizer 6153 may pressurize and fix both sides of the right end of the laundry together with the first right wing pressurizer 6115*b*. A left and right length of the first right clip pressurizer 6153 may be provided to be shorter than that of the first right wing 6115.

The first right wing protrusion 6115*d* may be provided between the end of the first right clip pressurizer 6153 and the center 6111 of the first support unit. Therefore, it is preferable to allow the sewing line of the laundry not to be pressurized by the first support unit and the first right clip.

Figure 6A:
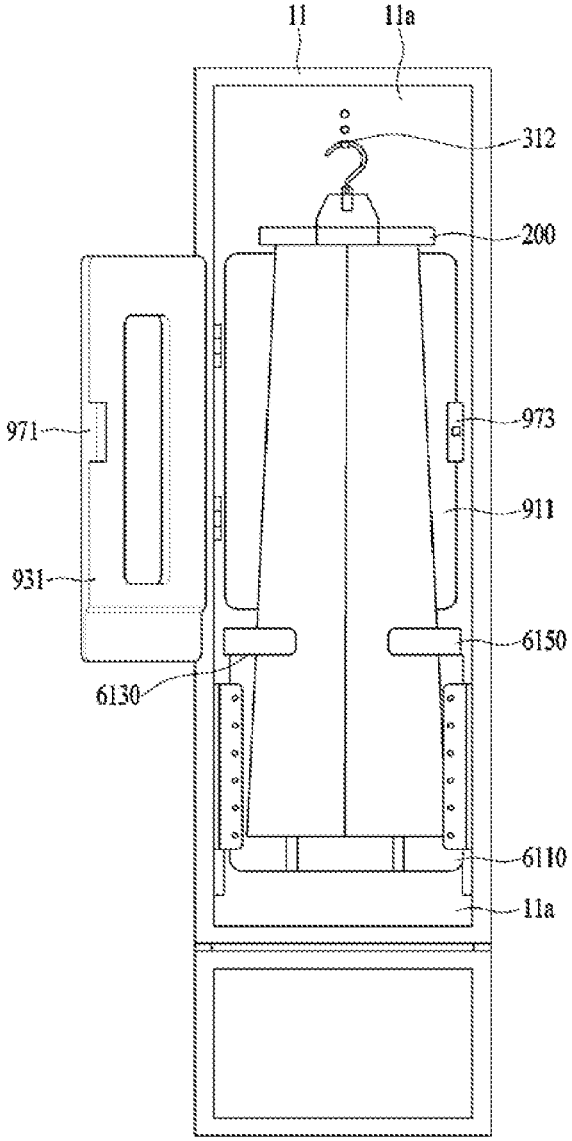
FIGS. 6A and 6B are views illustrating a usage example of a clamp unit 6100 according to the first embodiment of the present invention.
Figure 6B:
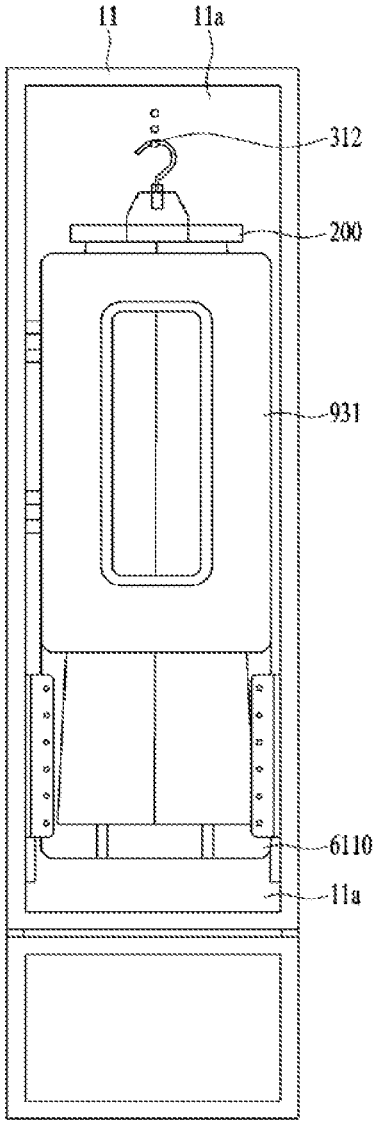

FIGS. 6A and 6B are views illustrating a usage example of a clamp unit 6100 according to the first embodiment of the present invention.

A usage example of the clamp unit according to the first embodiment will be described with reference to FIG. 6A. A hanger to which an end of the laundry is fixed is held in the second laundry support unit 312 in a state that the compression body 931 is opened, and a portion where a wrinkle or crease is generated on the laundry is supported on the surface of the support body 911. In this case, the portion where the wrinkle or crease is generated on the laundry is arranged on the surface of the support body 911 such that the sewing line of the laundry is arranged in the support body groove 913 or the compression body groove 937, and the shape of the laundry is aligned such that the crease previously set may be pressurized by the compression body 931.

Both ends of the laundry are fixed to the first left clip 6130 and the first right clip 6150 to maintain the position and shape of the laundry in the middle of closing the compression body 931. Afterwards, as shown in FIG. 6B, the compression body 931 is fixed to the support body 911 to pressurize the laundry, and the wrinkle generated on the laundry is removed and the crease previously set is pressed clearly.

Figure 7:
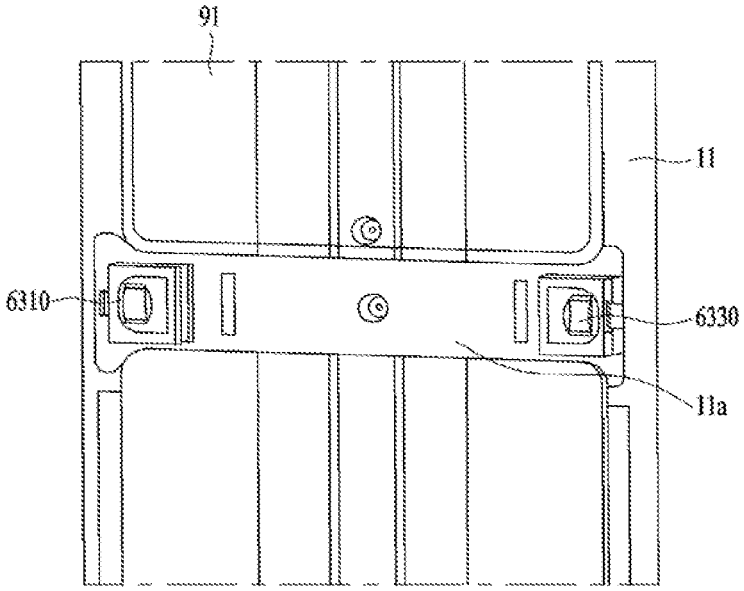
FIG. 7 is a view illustrating a clamp unit 6300 according to the second embodiment of the present invention.
Figure 8:
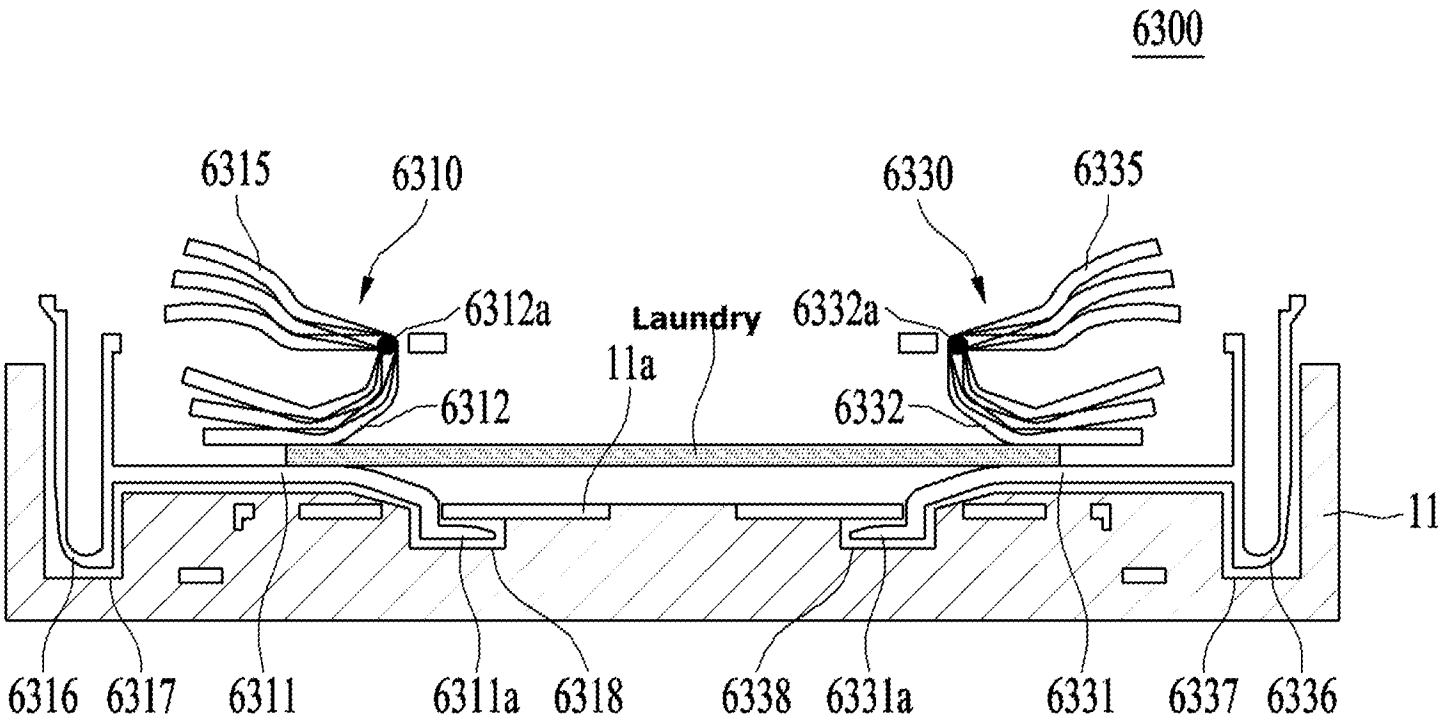
FIG. 8 is a view illustrating a section of a clamp unit 6300 according to the second embodiment of the present invention.

FIG. 7 is a view illustrating a clamp unit 6300 according to the second embodiment of the present invention. FIG. 8 is a view illustrating a section of a clamp unit 6300 according to the second embodiment of the present invention.

Referring to FIG. 7, the clamp unit 6300 according to the second embodiment may include a second left clip 6310 provided to be fixed to the receiving space 31, fixing both ends of the laundry, and a second right clip 6330 provided to be fixed to the receiving space 31, fixing right ends of the laundry.

The second left clip 6310 and the second right clip 6330 may be provided to face each other, and may be provided at the same height.

The second left clip and the second right clip may be provided on the inner side of the receiving space, the inner side 11*a* of the door, below the presser 9. In FIG. 7, the second left clip and the second right clip are provided on the inner side 11*a* of the door.

Referring to FIG. 8, the second left clip 6310 may include a second left clip support unit 6311 for supporting a left end of the laundry, and a second left clip pressurizer 6312 for pressurizing both sides of the laundry together with the second left clip support unit.

The second left clip support unit 6311 is provided to be fixed to the inner side 11*a* of the door, and supports one side of both ends of the laundry.

The second left clip 6310 may include a second left clip joint 6316 extended from a left end of the second left clip support unit 6311 to the inner side of the door to fix the second left clip to the inner side 11*a* of the door.

The second left clip support unit 6311 includes a second left clip support protrusion 6311*a* provided to be extended from an end to the center of the laundry, wherein the second left clip support protrusion 6311*a* is inserted into a second left support groove 6318 provided on the inner side 11*a* of the door, and the second left clip joint 6316 is inserted and fixed into the second left joint hole 6317 provided on the inner side 11*a* of the door, whereby the second left clip 6310 may be fixed to the inner side of the door.

The second left clip pressurizer 6312 may be provided to be spaced apart from the second left clip support unit 6311 at a predetermined interval, or may be provided to be in contact with the surface of the second left clip support unit 6311.

The second left clip pressurizer 6312 is rotatably provided relatively with respect to the second left clip support unit 6311. A rotational shaft of the second left clip pressurizer 6312 may be provided in a height direction or up and down direction of the laundry treating apparatus.

The second left clip pressurizer 6312 may store an elastic force by being rotated by means of an external force from the laundry in an insertion direction of the laundry when the laundry is inserted between the second left clip support unit and the second left clip pressurizer, wherein the stored elastic force may act as a restoring force. The second left clip pressurizer 6312 may pressurize and fix the laundry inserted between the second left clip pressurizer and the second left clip support unit by using the stored elastic force as a restoring force.

The second left clip pressurizer is rotated to be far away from the second left clip support unit when the laundry is inserted between the second left clip support unit and the second left clip pressurizer.

Figure 10:
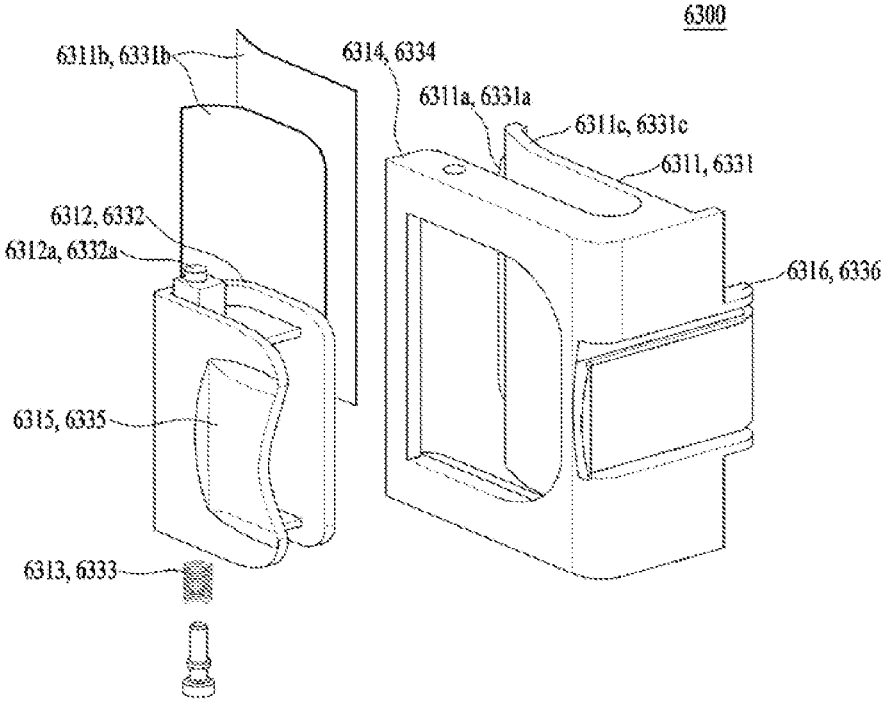
FIG. 10 is an exploded perspective view illustrating a clamp unit 6300 according to the second embodiment of the present invention.

The second left clip 6310 may include a second left clip elastic member 6313 on a rotational shaft of the second left clip pressurizer 6312 to provide an elastic force according to rotation of the second left clip pressurizer 6312 (see FIG. 10).

The second right clip 6330 may include a second right clip support unit 6331 for supporting a right end of the laundry, and a second right clip pressurizer 6332 for pressurizing both sides of the laundry together with the second right clip support unit.

The second right clip support unit 6331 is provided to be fixed to the inner side 11*a* of the door, and supports one side of a right end of the laundry.

The second right clip 6330 may include a second right clip joint 6336 extended from a right end of the second right clip support unit 6331 to the inner side of the door to fix the second right clip to the inner side 11*a* of the door.

The second right clip support unit 6331 includes a second right clip support protrusion 6331*a* provided to be extended from an end to the center of the laundry, wherein the second right clip support protrusion 6331*a* is inserted into a second right support groove 6338 provided on the inner side 11*a* of the door, and the second right clip joint 6336 is inserted and fixed into the second right joint hole 6317 provided on the inner side 11*a* of the door, whereby the second right clip 6330 may be fixed to the inner side of the door.

The second right clip pressurizer 6332 may be provided to be spaced apart from the second right clip support unit 6331 at a predetermined interval, or may be provided to be in contact with the surface of the second right clip support unit 6331.

The second right clip pressurizer 6332 is rotatably provided relatively with respect to the second right clip support unit 6331. A rotational shaft of the second right clip pressurizer 6332 may be provided in a height direction or up and down direction of the laundry treating apparatus.

The second right clip pressurizer 6332 may store an elastic force by being rotated by means of an external force from the laundry in an insertion direction of the laundry when the laundry is inserted between the second right clip support unit and the second right clip pressurizer, wherein the stored elastic force may act as a restoring force. The second right clip pressurizer 6332 may pressurize and fix the laundry inserted between the second right clip pressurizer and the second right clip support unit by using the stored elastic force as a restoring force.

The second right clip pressurizer is rotated to be far away from the second right clip support unit when the laundry is inserted between the second right clip support unit and the second right clip pressurizer.

The second right clip 6330 may include a second right clip elastic member 6333 on a rotational shaft of the second right clip pressurizer 6332 to provide an elastic force according to rotation of the second right clip pressurizer 6332 (see FIG. 10).

Figure 9:
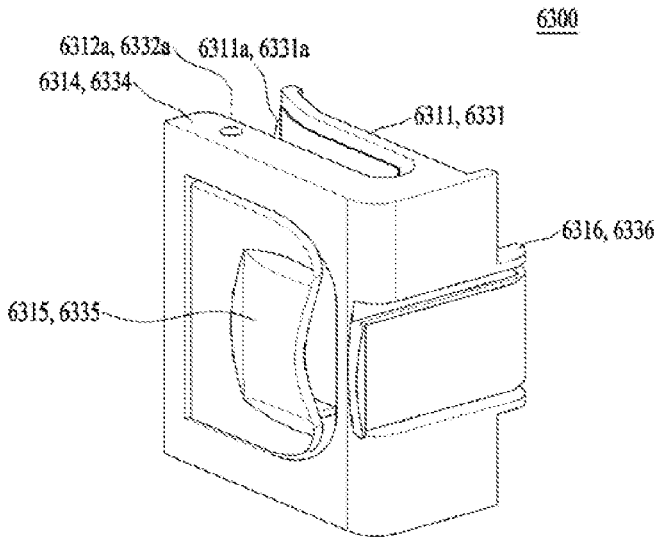
FIG. 9 is a perspective view illustrating a clamp unit 6300 according to the second embodiment of the present invention.

FIG. 9 is a perspective view illustrating a clamp unit 6300 according to the second embodiment of the present invention. FIG. 10 is an exploded perspective view illustrating a clamp unit 6300 according to the second embodiment of the present invention.

Referring to FIGS. 9 and 10, the second left clip 6310 may include a second left clip grip 6315 extended from the second left clip pressurizer 6312 to rotate the second left clip pressurizer 6312 in an insertion direction of the laundry inserted between the second left clip support unit 6311 and the second left clip pressurizer 6312.

If a force is applied to the second left clip grip 6315, the second left clip pressurizer 6312 is rotated to release a force that pressurizes the laundry.

The second left clip 6310 may include a second left clip extension portion 6314 provided to be spaced apart from the second left clip support unit 6311 at a predetermined interval. The second left clip extension portion 6314 may be extended from the second left clip support unit 6311. The second left clip extension portion 6314 and the second left support unit 6311 may be provided to be opened toward the laundry. In this case, a '⊏' opened toward the laundry may be formed.

Also, a length of the second left clip extension portion in a center direction of the laundry may be provided to be the same as that of the second left clip support unit in the center direction of the laundry.

A rotational shaft 6312*a* of the second left clip pressurizer 6312 may be provided at an end of the second left clip extension portion 6314 or at a position spaced apart from the end at a predetermined interval. To support the rotational shaft 6312*a* at both sides, the second left clip extension portion may be provided to be extended from the second left clip support unit 6311 to both sides of the second left clip pressurizer 6312. Alternatively, as shown in FIG. 10, the second left clip extension portion may be provided with a second left clip through hole 6314*a* that may insert the second left clip pressurizer 6312 into the inner side.

Also, the second left clip elastic member 6313 that provides an elastic force to the second left clip pressurizer may be provided in the rotational shaft 6312*a* of the second left clip pressurizer, and the second left clip elastic member 6313 may be provided as a torsion spring. In this case, the elastic force is provided such that the end of the second left clip pressurizer is rotated toward the second left clip support unit.

Also, the second left clip 6310 may include a damper 6311*b* of a rubber material on at least one surface of the second left clip support unit and the second left clip pressurizer to fix the laundry inserted between the second left clip support unit 6311 and the second left clip pressurizer. Therefore, the damper 6311*b* of a rubber material may fix the laundry so as not to be ejected from the second left clip by increasing a frictional force with the laundry.

Also, the second left clip 6310 may include an inclined portion 6111*c*, in which an interval between the second left clip support unit and the second left clip pressurizer is increased toward the center of the laundry, on at least one surface of the second left clip support unit and the second left clip pressurizer, so that the laundry may easily be inserted between the second left clip support unit 6311 and the second left clip pressurizer 6312.

Meanwhile, the second right clip 6330 may include a second right clip grip 6335 extended from the second right clip pressurizer 6332 to rotate the second right clip pressurizer 6332 in an insertion direction of the laundry inserted between the second right clip support unit 6331 and the second right clip pressurizer 6332.

If a force is applied to the second right clip grip 6335, the second right clip pressurizer 6332 is rotated to release a force that pressurizes the laundry.

The second right clip 6330 may include a second right clip extension portion 6334 provided to be spaced apart from the second right clip support unit 6331 at a predetermined interval. The second right clip extension portion 6334 may be extended from the second right clip support unit 6331. The second right clip extension portion 6334 and the second right support unit 6332 may be provided to be opened toward the laundry. In this case, a '⊏' opened toward the laundry may be formed.

Also, a length of the second right clip extension portion in a center direction of the laundry may be provided to be the same as that of the second right clip support unit in the center direction of the laundry.

A rotational shaft 6332*a* of the second right clip pressurizer 6332 may be provided at an end of the second right clip extension portion 6334 or at a position spaced apart from the end at a predetermined interval. To support the rotational shaft 6332*a* at both sides, the second right clip extension portion may be provided to be extended from the second right clip support unit 6331 to both sides of the second right clip pressurizer 6332. Alternatively, as shown in FIG. 10, the second right clip extension portion may be provided with a second right clip through hole 6334*a* that may insert the second right clip pressurizer 6332 into the inner side.

Also, the second right clip elastic member 6333 that provides an elastic force to the second right clip pressurizer may be provided in the rotational shaft 6332*a* of the second right clip pressurizer, and the second right clip elastic member 6333 may be provided as a torsion spring. In this case, the elastic force is provided such that the end of the second right clip pressurizer is rotated toward the second right clip support unit.

Also, the second right clip 6330 may include a damper 6331*b* of a rubber material on at least one surface of the second left clip support unit and the second left clip pressurizer to fix the laundry inserted between the second right clip support unit 6331 and the second right clip pressurizer 6332. Therefore, the damper 6331*b* of a rubber material may fix the laundry so as not to be ejected from the second right clip by increasing a frictional force with the laundry.

Also, the second right clip 6330 may include an inclined portion 6111*c*, in which an interval between the second right clip support unit and the second right clip pressurizer is increased toward the center of the laundry, on at least one surface of the second right clip support unit and the second right clip pressurizer, so that the laundry may easily be inserted between the second right clip support unit 6331 and the second right clip pressurizer 6332.

Figure 11A:
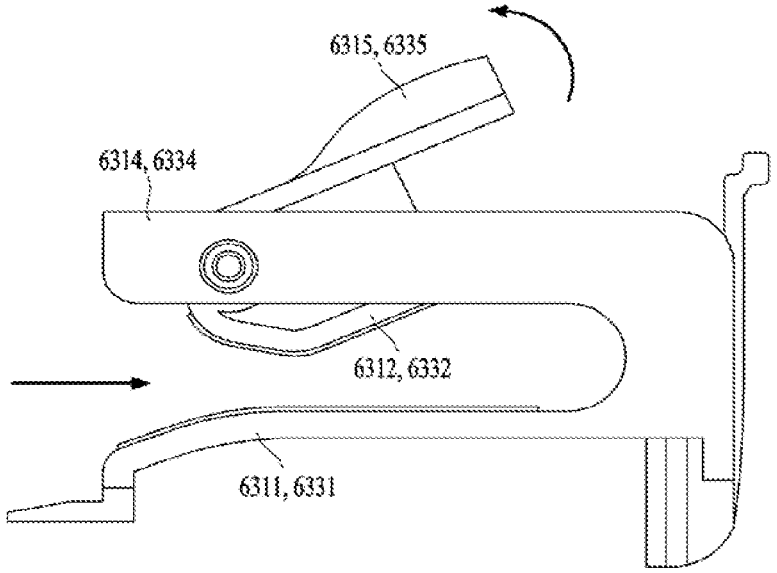
FIGS. 11A and 11B are views illustrating a usage example of a clamp unit 6300 according to the second embodiment of the present invention.
Figure 11B:
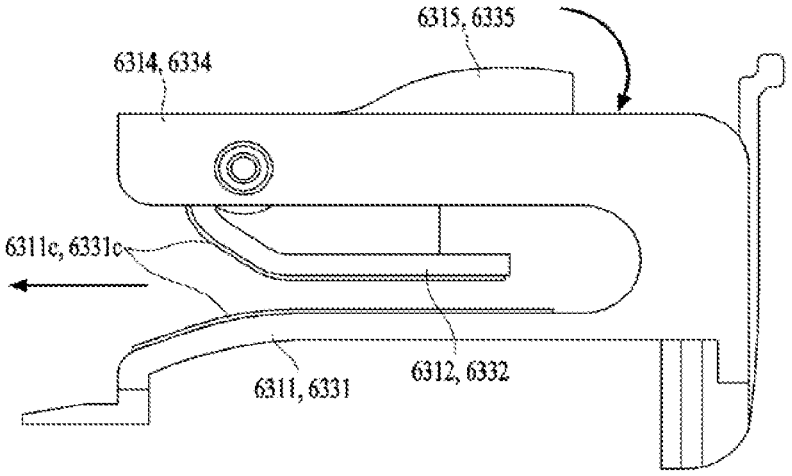

FIGS. 11A and 11B are views illustrating a usage example of a clamp unit 6300 according to the second embodiment of the present invention.

As shown in FIG. 11A, if the laundry is fixed, and if the laundry is inserted between the second clip support unit 6311 or 6311 and the second clip extension portion 6314 or 6334, the second clip pressurizer 6312 or 6332 to which an external force is applied by the laundry is rotated (the second clip pressurizer may be rotated by applying an external force to the second clip grip 6315 or 6335), and pressurizes the laundry by being rotated in an opposite direction by means of a restoring force received by the second left elastic member 6313 or 6333 provided in the rotational shaft 6312*a* or 6332*a* of the second clip pressurizer 6312 or 6332 that is rotated.

On the other hand, as shown in FIG. 11B, if fixation of the laundry is released, and if the external force is applied to the second clip grip 6315 or 6335, the second clip pressurizer 6312 or 6332 is rotated to be spaced apart from the second clip support unit 6311 or 6331, whereby the laundry is not pressurized any more and fixation of the laundry is released.

Figure 12:
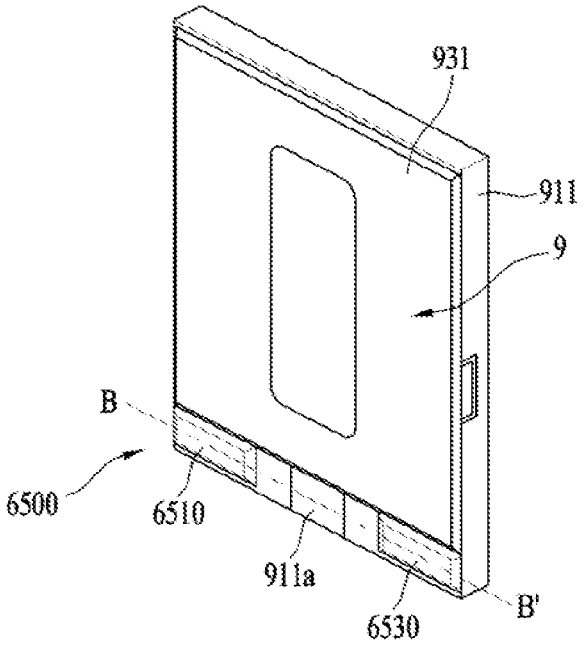
FIG. 12 is a view illustrating a clamp unit 6500 according to the third embodiment of the present invention.
Figure 13A:
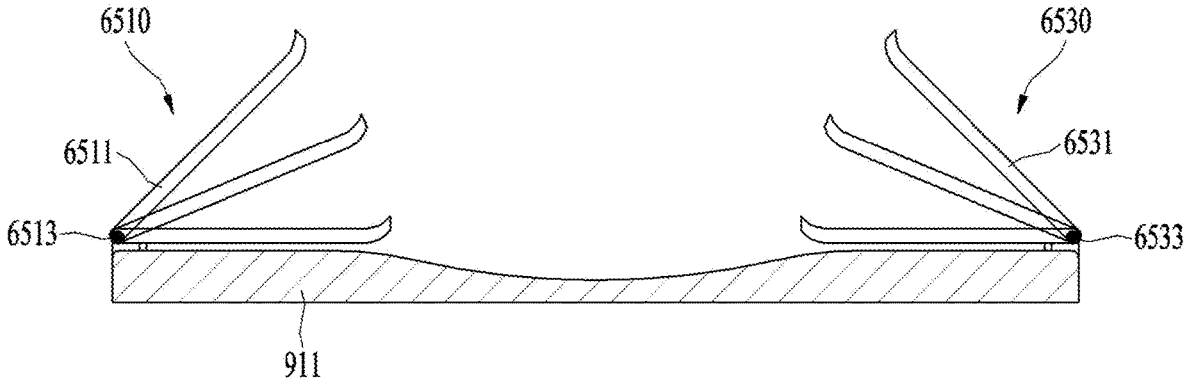
FIGS. 13A and 13B are sectional views taken along line B-B' of FIG. 12.
Figure 13B:
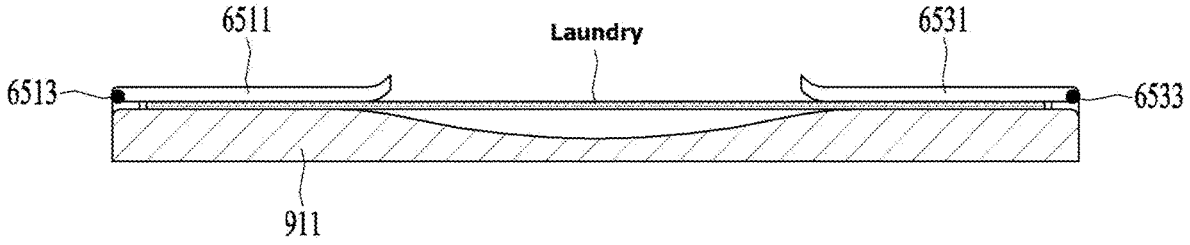

FIG. 12 is a view illustrating a clamp unit 6500 according to the third embodiment of the present invention. FIGS. 13A and 13B are sectional views taken along line B-B' of FIG. 12.

The claim unit 6500 according to the third embodiment may include a left folder 6510 rotatably provided in the receiving space 31 to fix a left end of the laundry, and a right folder 6530 rotatably provided in the receiving space 31 to fix a right end of the laundry.

The left folder and the right folder may be provided in parallel to face each other, and may be provided at the same height.

Even though the laundry is pressurized by the left folder and the right folder, the sewing line (center) of the laundry may be provided so as not be pressurized.

The clamp unit 6500 according to the third embodiment may be provided to be installed on the inner side of the receiving space 31, to be installed on the inner circumference of the door, or to be formed in a single body with the presser 9. As an example, FIG. 12 illustrates that the claim unit is provided in the presser 9.

Referring to FIG. 12, the clamp unit according to the third embodiment may be provided in the support body extension portion 911*a* extended from the support body 911 to the lower side. The clamp unit 6500 may be provided near the lower side of the compression body 931. Therefore, the laundry may be fixed such that a portion of the laundry closest to the laundry compressed by the compression body 931 and the support body 911 may be fixed so as not to change the position and shape of the laundry.

Referring to FIG. 13A, the left folder 6510 may include a left folder body 6511 pressurizing a left end of the laundry, and a left folder hinge 6513 rotatably connecting the left folder body to the extension portion 911*a* of the support body.

The left folder body 6511 may be provided in a plate shape to enable a surface contact with the laundry. The left folder hinge 6513 may include a torsion spring (not shown) therein such that the left folder body 6511 is rotated in a direction of the support body extension portion during rotation of the left folder body 6511 and the support body extension portion 911*a* within a predetermined threshold angle therebetween.

Also, a damper (not shown) of a rubber material may be provided on the surface of the left folder body 6511 to increase a frictional force with the laundry.

Meanwhile, the right folder 6530 may include a right folder body 6531 pressurizing a left end of the laundry, and a right folder hinge 6533 rotatably connecting the right folder body to the extension portion 911*a* of the support body.

The right folder body 6531 may be provided in a plate shape to enable a surface contact with the laundry. The right folder hinge 6533 may include a torsion spring (not shown) therein such that the right folder body 6531 is rotated in a direction of the support body extension portion during rotation of the right folder body 6531 and the support body extension portion 911*a* within a predetermined threshold angle therebetween.

Also, a damper (not shown) of a rubber material may be provided on the surface of the right folder body 6531 to increase a frictional force with the laundry.

As shown in FIG. 13B, the left folder and the right folder may prevent the position and shape of the laundry from being changed by respectively pressurizing the left end and the right end of the laundry, thereby preventing a double crease from being generated when the laundry supported in the support body is pressurized by the compression body.

Figure 14:
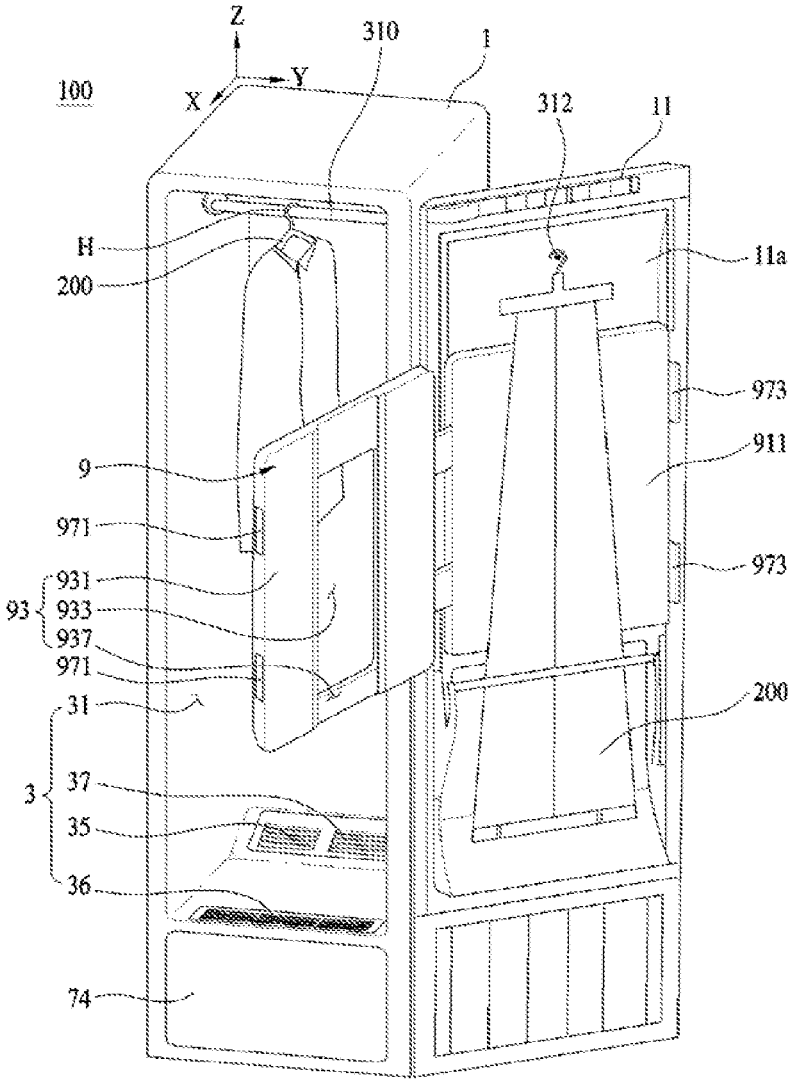
FIG. 14 is a view illustrating a laundry treating apparatus according to another embodiment of the present invention.

FIG. 14 is a view illustrating a laundry treating apparatus according to another embodiment of the present invention. Hereinafter, the laundry treating apparatus according to another embodiment of the present invention will be described with reference to FIG. 14.

The laundry treating apparatus 100 according to another embodiment of the present invention may include a cabinet 1, a laundry receiving unit 3 provided inside the cabinet 1 to receive laundry therein, a door 11 rotatably connected to the cabinet 1 to open or close a receiving space 31, and a laundry support unit provided in the receiving space 31 to support laundry.

The cabinet 1 may form an external appearance of the laundry treating apparatus 100 according to another embodiment of the present invention, and may have a rectangular shape.

The laundry receiving unit 3 may include the receiving space 31 arranged inside the cabinet 1, providing a space where laundry is received.

The laundry support unit may include at least one of a first laundry support unit 310 provided inside the receiving space 31 and a second laundry support unit 312 provided in the door 11.

The first laundry support unit 310 may be provided in a bar shape provided along a width direction (width direction of the door, Y-axis direction) of the receiving space 31.

The second laundry support unit 312 may be provided at an inner side 11*a* of the door 11 such that laundry is arranged inside the receiving space 31 in a state that the laundry is unfolded.

Meanwhile, the laundry treating apparatus according to another embodiment of the present invention includes elements shown in FIGS. 2 and 3, and its description will be omitted to avoid repetition with the aforementioned description.

Figure 15:
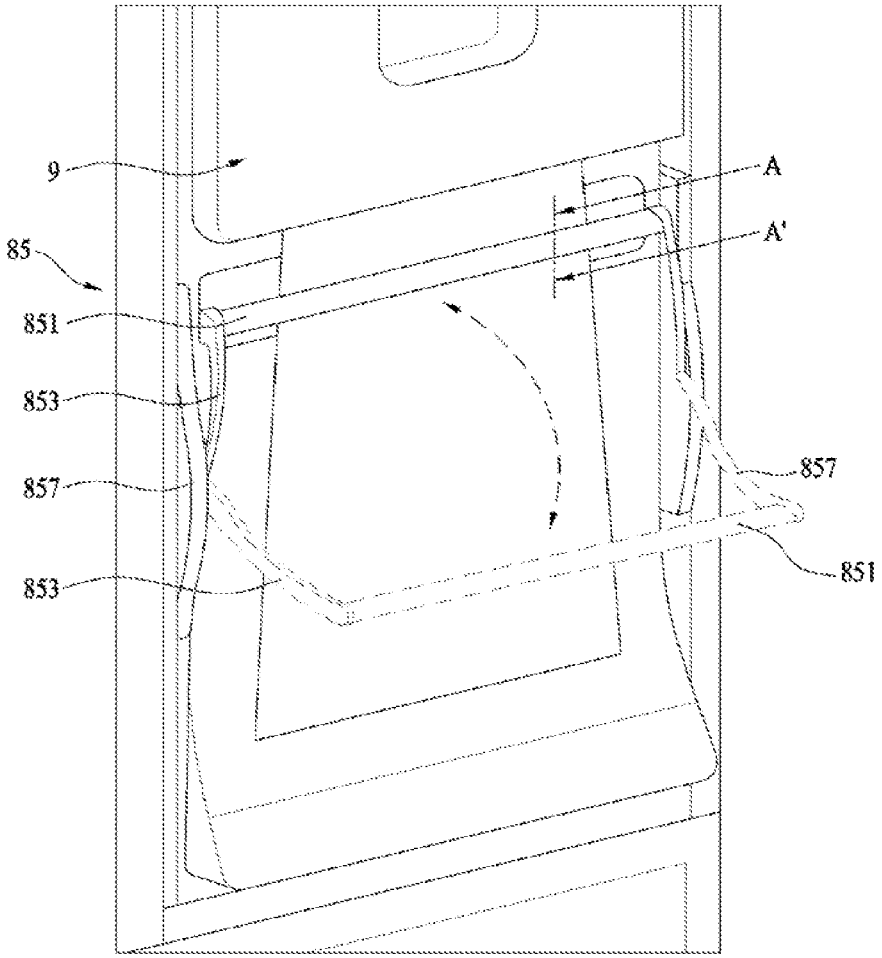
FIG. 15 is an enlarged view illustrating a clamp unit provided in a laundry treating apparatus according to another embodiment of the present invention.

FIG. 15 is an enlarged view illustrating a clamp unit 85 provided in a laundry treating apparatus according to another embodiment of the present invention.

The user pressurizes the laundry by coupling the compression body 931 to the support body 911 by arranging the sewing line provided in the laundry in the support body groove 913 or the compression body groove 937 and then rotating the compression body 931 in a direction of the support body 911. In this process, the position of the laundry is changed, whereby a problem occurs in that an unnecessary crease is generated on the laundry.

To solve the problem, as shown in FIG. 15, the laundry treating apparatus according to another embodiment of the present invention may include a clamp unit 85 for fixing the laundry before pressurizing the laundry arranged in the support body 911 by using the compression body 931.

Since the user may fix the position of the laundry through the clamp unit 85 after arranging the sewing line of the laundry in the support body groove 913 and aligning the crease previously set on the laundry, the likelihood that the sewing line of the laundry is detached from the support body groove 913 or a double crease is generated on the laundry may be minimized during the process of coupling the compression body 931 to the support body 911.

The clamp unit 85 may be installed below the presser 9. If the presser 9 is installed on the inner side 11*a* of the door 11, the clamp unit 85 may also be installed on the inner side 11*a* of the door 11 below the presser 9.

Figure 16:
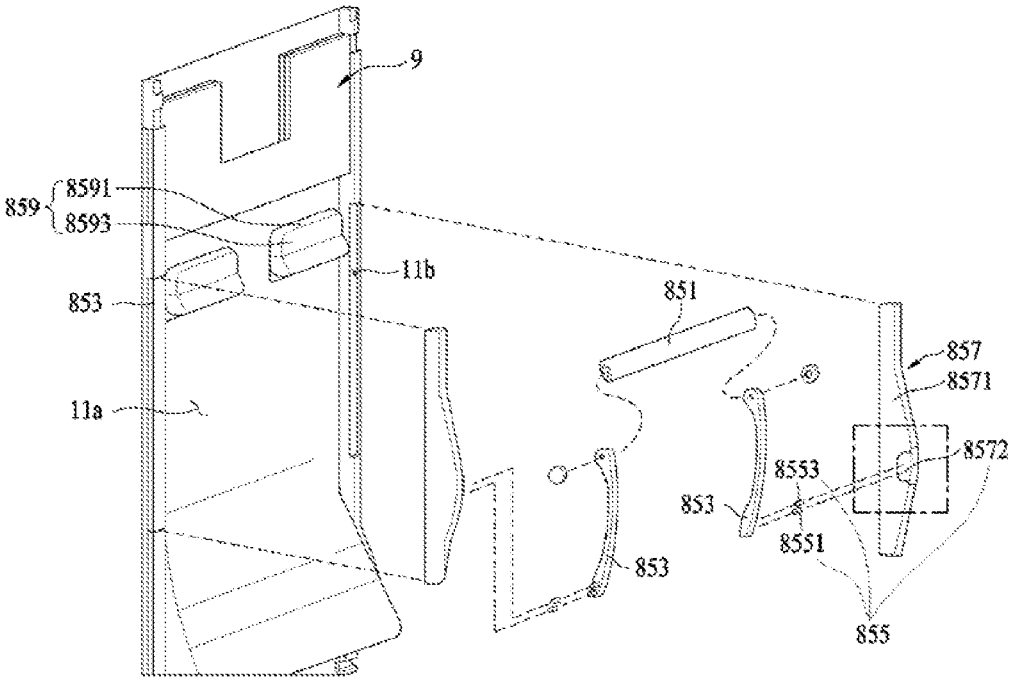
FIG. 16 is an exploded perspective view illustrating a clamp unit provided in a laundry treating apparatus according to another embodiment of the present invention.

FIG. 16 is an exploded perspective view illustrating a clamp unit provided in a laundry treating apparatus according to another embodiment of the present invention.

Referring to FIG. 16, the clamp unit 85 may include a compression unit 851 for compressing the laundry, and a link 853 rotatably connected into the receiving space 31 by a rotation unit 855.

The compression unit 851 may serve to pressurize and fix one surface of the laundry so that the position and shape of the laundry may not be changed before pressurizing the laundry arranged in the support body 911 by using the compression body 931.

The compression unit 851 may have a bar shape, and the bar shaped compression unit 851 may prevent the laundry from being detached from the original position by pressurizing one surface of the laundry. The laundry is provided to be arranged between the inner side 11*a* of the door 11 and the compression unit 851.

The link 853 has one end connected to the compression unit 851, and the other end rotatably connected to the inner circumference of the receiving space 31 or the inner side 11*a* of the door.

The link 853 is rotatably connected to the inner circumference of the receiving space 31 or the inner side 11*a* of the door 11 by the rotation unit 855. The link 853 is rotatably connected in a height direction of the laundry treating apparatus according to another embodiment of the present invention. In this case, a rotational shaft of the link 853 may be provided in parallel with the ground.

The compression unit 851 connected to one end of the link 853 using the other end of the link 853 as a rotation center may be rotated in a height direction of the laundry treating apparatus according to another embodiment of the present invention. An interval between the compression unit 851 and the inner circumference of the receiving space 31 or the inner side 11*a* of the door 11 may be adjusted in accordance with rotation of the link 853.

The user may rotate the compression unit and the link by applying an external force to the compression unit 851, and an interval occurs between the compression unit 851 and the inner side 11*a* of the door. If the laundry is inserted into the interval and the external force acting on the compression unit 851 is removed, the compression unit 851 may prevent the position or shape of the laundry from being changed by pressurizing the laundry between the compression unit 851 and the inner side of the door.

Although the link 853 may be provided in a straight-line shaped bar, the link 853 may be provided in a bow shape convex in a direction far away from the laundry.

The link 853 may include a left link and a right link at both sides of the laundry, and both ends of the compression unit may respectively be connected to the left link and the right link, wherein each of the left link and the right link may rotatably be connected to the door by the rotation unit.

Meanwhile, the rotation unit 855 is intended to rotatably connect the link 853 to the receiving space 41 or the door 11. FIG. 16 illustrates that the rotation unit 855 is provided on the inner circumference of the door 11. Hereinafter, the case that the rotation unit 855 is provided in the door 11 will be described.

In one example, the rotation unit 855 connects the link to the door 11 by means of a fixed rotational shaft, and includes a joint member (not shown) for fixing the link or the compression unit to the door to pressurize and fix the laundry.

Also, in one example, the rotation unit 855 connects the link to the door 11 by means of a moving rotational shaft, and may pressurize and fix the laundry without a separate joint member. Hereinafter, the rotation unit 855 having the moving rotational shaft will be described.

In one example, the rotation unit 855 may include a closing protrusion 8551 protruded from the link, an opening protrusion 8553 spaced apart from the closing protrusion 8551 and protruded from the link, and a guide groove 8572 for guiding the closing protrusion 8551 and the opening protrusion 8553.

The closing protrusion 8551 may be provided at a side end of the link, wherein the side of the link may mean an opposite side of a side through which the user views the laundry.

The opening protrusion 8553 may be provided to be spaced apart from the closing protrusion at a predetermined interval at the side end of the link. The opening protrusion 8553 may be provided to be further away from the end of the link than the closing protrusion.

The guide groove 8572 provides a predetermined space, into which the closing protrusion 8551 and the opening protrusion 8553 are inserted to allow the closing protrusion 8551 and the opening protrusion 8553 to move therein, and may guide and restrict movement of the closing protrusion 8551 and the opening protrusion 8553.

Figure 17:
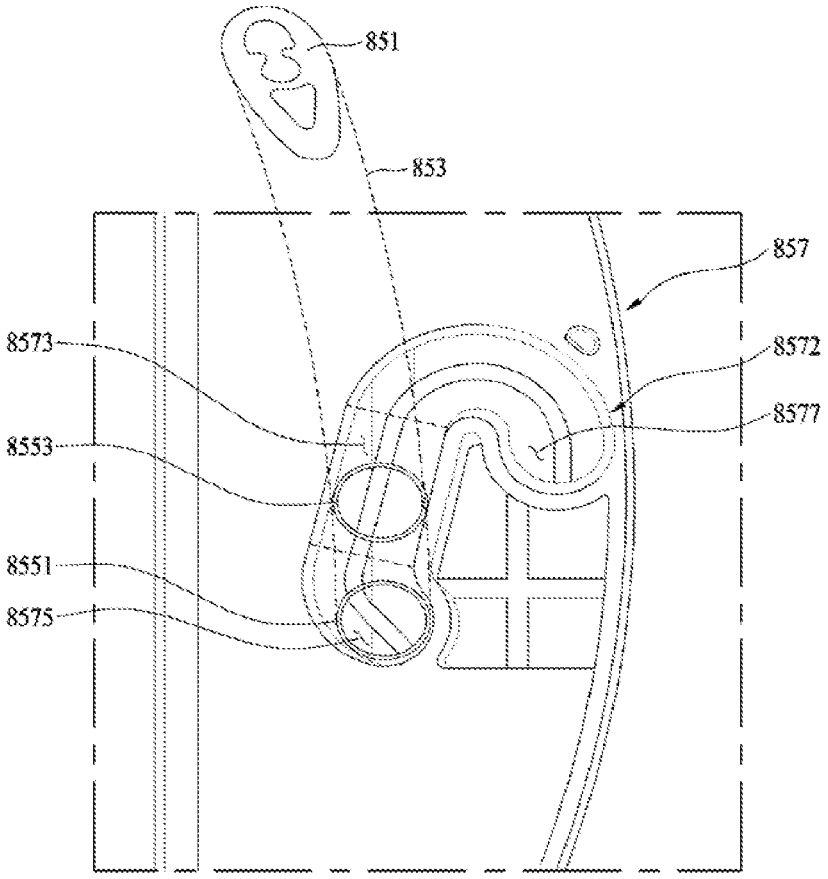
FIG. 17 is a sectional view illustrating a rotation unit provided in a laundry treating apparatus according to another embodiment of the present invention, especially illustrating a state that laundry is pressurized by a compression unit.

FIG. 17 is a sectional view illustrating a rotation unit provided in a laundry treating apparatus according to another embodiment of the present invention, especially illustrating a state that laundry is pressurized by a compression unit.

Referring to FIG. 17, the guide groove 8572 may directly be provided on the inner side of the door 11, or may be provided in a separate guide 857 detachably installed in the door 11. FIG. 17 illustrates that the guide groove is provided in the guide 857 as an example.

The guide 857 may be installed in a guide joint 11*b* provided on the inner side 11*a* of the door, and the guide joint 11*b* may be provided on the inner circumference at both ends of the door below the presser, and may have a concave shape to allow the guide to be inserted therein.

The guide groove 8572 may be formed on a surface through which the laundry is viewed from the guide 857. If the closing protrusion and the opening protrusion are inserted into the guide groove 8672 and guided by the guide groove 8672, the link is provided to be closer to the center of the door than the guide.

If the closing protrusion 8551 and the opening protrusion 8553 are inserted into the guide groove 8572, the closing protrusion 8551 may be provided to be lower than the opening protrusion 8553.

The guide groove 8572 may include a first guide groove 8573 which is far away from the laundry toward the upper side from a height direction of the laundry treating apparatus according to another embodiment of the present invention.

The first guide groove 8573 is provided to be inclined relatively with respect to the door, and may provide a space where the closing protrusion and the opening protrusion may perform straight-line motion.

The first guide groove 8573 may guide the closing protrusion 8551 and the opening protrusion 8553 in a height direction of the laundry treating apparatus according to another embodiment of the present invention. As the closing protrusion and the opening protrusion are guided to the lower side by the first guide groove, the link 853 and the compression unit 851 may move to the lower side and may have a narrow interval with the laundry, and the compression unit 851 may pressurize the laundry.

If the closing protrusion 8551 reaches the lower end of the first guide groove 8573, the compression unit 851 may be provided to pressurize the laundry.

On the other hand, as the closing protrusion and the opening protrusion are guided to the upper side by the first guide groove, the link and the compression unit may move to the upper side and have a wide interval with the laundry, and pressurization of the compression unit for the laundry may be released, whereby the position and shape of the laundry may be adjusted.

Meanwhile, the distance between the closing protrusion 8551 and the opening protrusion 8553 is provided to be shorter than the length of the first guide groove 8573, whereby a sufficient space that enables straight-line motion of the closing protrusion 8551 and the opening protrusion 8553 is provided by the guide groove 8573.

Meanwhile, in one embodiment, the guide groove 8572 may include a second guide groove 8575 connected from the lower end of the first guide groove 8573 and far away from the laundry toward the lower side.

The second guide groove 8575 may be provided to be inclined relatively with respect to the door, and may provide a predetermined space to allow the closing protrusion 8551 to enable straight-line motion.

The second guide groove 8575 and the first guide groove 8573 are provided to be communicated with each other, and the closing protrusion 8551 guided in the first guide groove may move into the second guide groove. Each guide groove may be provided to be relatively far away from the door as each guide groove is far away from the portion where the first guide groove and the second guide groove meet each other.

The second guide groove 8575 has a length shorter than that of the first guide groove 8573. Also, the length of the second guide groove 8575 may be provided to be shorter than that between the closing protrusion 8551 and the opening protrusion 8553. Therefore, in the closing protrusion and the opening protrusion guided in the first guide groove 8573, the closing protrusion 8551 is only guided in the second guide groove, and the opening protrusion 8553 is only guided in the first guide groove without being inserted into the second guide groove.

At the time when the closing protrusion 8551 moves to the lower side in the first guide groove 8573 and is inserted into the second guide groove connected to the end of the first guide groove, the link 853 is rotated toward the laundry such that the compression unit 851 is close to the door. The compression unit pressurizes the laundry such that the position or shape of the laundry is not changed.

The compression unit 851 serves as a stopper that prevents the closing protrusion 8551 from being detached from the second guide groove 8575, whereby the link is not rotated and a pressurizing force of the compression unit 851 with respect to the laundry may be enhanced.

Figure 18:
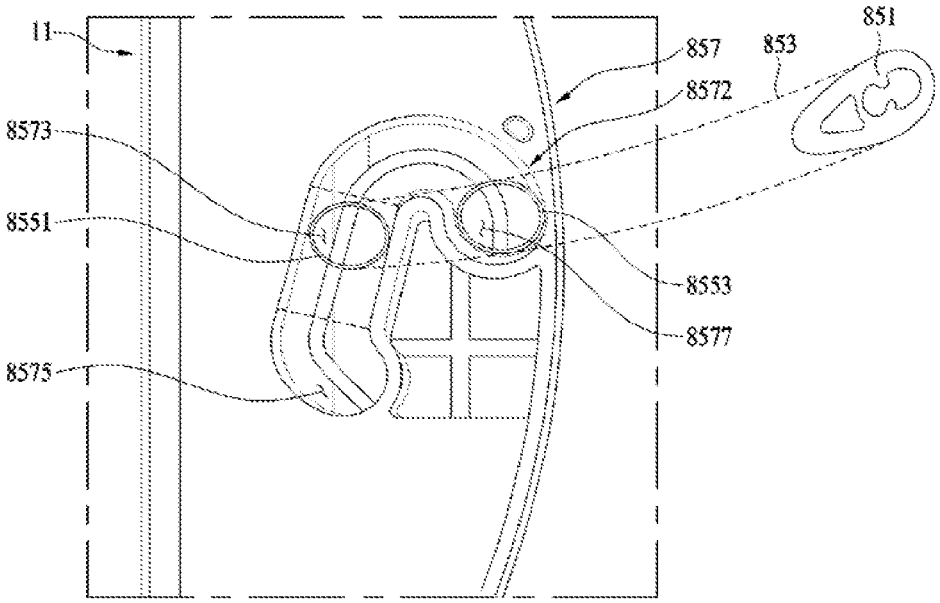
FIG. 18 is a sectional view illustrating a rotation unit provided in a laundry treating apparatus according to another embodiment of the present invention, especially illustrating a state that pressurization of laundry is released by a compression unit.

FIG. 18 is a sectional view illustrating a rotation unit provided in a laundry treating apparatus according to another embodiment of the present invention, especially illustrating a state that pressurization of laundry is released by a compression unit.

Referring to FIG. 18, in one embodiment, the guide groove 8572 may include a third guide groove 8577 connected to the upper end of the first guide groove 8573 and formed to be far away from the laundry.

The third guide groove 8577 is intended to insert the laundry between the compression unit and the door by releasing pressurization of the laundry from the clamp unit.

The inside of the third guide groove 8577 is communicated with the inside of the first guide groove 8573, and the opening protrusion 8553 may move into the first guide groove 8573 and then move into the third guide groove 8577.

The third guide groove 8577 may provide a space where the opening protrusion 8553 may perform straight-line or curve motion to be far away from the laundry. However, in FIG. 18, the third guide groove provides a space where the opening protrusion enables curve motion.

In one example, the third guide groove 8577 may be provided in a reversed shape of a 'U' shape up and down. In one example, an end of the third guide groove 8577 may be provided between heights projected by the first guide groove 8573 in a vertical direction. For example, the end of the third guide groove 8577 may be provided to be arranged between virtual horizontal lines extended from the upper end and the lower end of the first guide groove. In one example, the end of the third guide groove 8577 may be provided to be arranged at the same height as that of a partial space constituting the inside of the first guide groove 8573. In one example, the third guide groove 8577 may be formed to be far away from the end of the first guide groove and constitute an arc in a downward direction.

The third guide groove 8577 may provide a space where the opening protrusion 8553 is held if the clamp unit 85 does not pressurize the laundry.

If an external force is applied to the clamp unit to upwardly move the clamp unit, the closing protrusion 8551 and the opening protrusion 8553 are upwardly guided by the first guide groove, and the opening protrusion 8553 is only inserted into the third guide groove 8577, and the closing protrusion 8551 stays in the first guide groove without being inserted into the third guide groove.

As the opening protrusion 8553 is inserted into the third guide groove 8577, the link is rotated to be far away from the laundry, and the compression unit that pressurizes the laundry moves to be also far away from the laundry.

Figure 19:
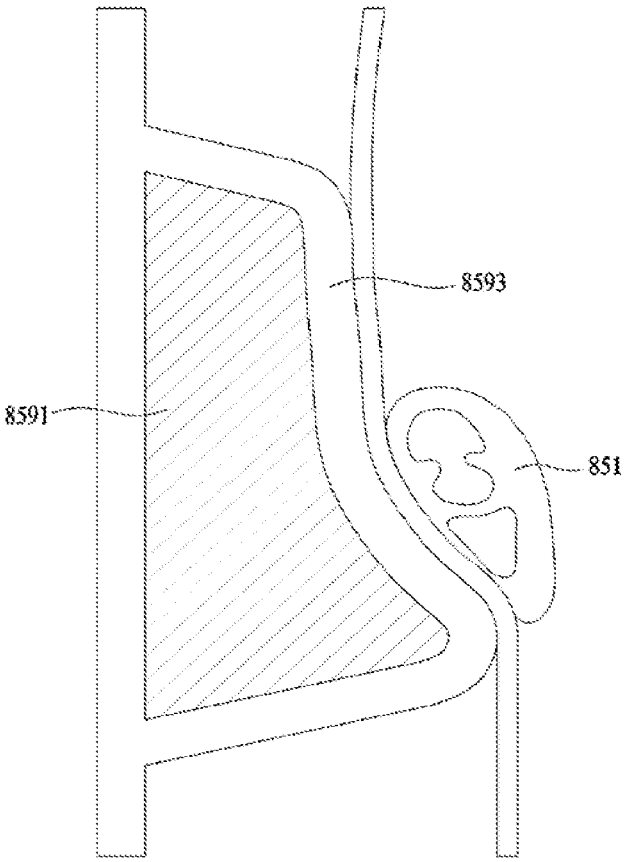
FIG. 19 is an enlarged view of A-A' of FIG. 15, illustrating a section of a protrusion and a compression unit, which are provided in a laundry treating apparatus according to another embodiment of the present invention.

FIG. 19 is an enlarged view of A-A' of FIG. 15, illustrating a section of a protrusion and a compression unit, which are provided in a laundry treating apparatus according to another embodiment of the present invention.

Referring to FIG. 19, the laundry treating apparatus according to another embodiment of the present invention may include a protrusion 859 provided in the receiving space or the door.

The laundry treating apparatus according to another embodiment of the present invention is provided such that the laundry is arranged between the protrusion 859 and the compression unit 851, and supports the laundry if the laundry is pressurized by the compression unit 851.

The protrusion 859 may include a protrusion body 8591 protruded from the inner side of the receiving space 31 or the inner side 11*a* of the door 11, and a protrusion inclined portion 8593 provided on a surface of the protrusion body 8591, which is in contact with the laundry.

The protrusion body 8591 may be provided in a single body with the inner side of the receiving space or the inner side 11*a* of the door or detachably. FIG. 19 illustrates an example of the protrusion body formed in a single body with the inner side of the door.

If the protrusion inclined portion 8593 supports one surface of the laundry, the compression unit 851 may uniformly fix the position and shape of the laundry by pressurizing the other surface of the laundry.

The protrusion inclined portion 8593 is provided to be close to the laundry toward the lower side. In other words, the protrusion inclined portion 8593 may be provided to be inclined such that the protrusion body 8591 may be provided to have a thick thickness toward the lower side.

The protrusion inclined portion 8593 may be provided such that an inclined slope is lowered toward the lower side. The compression unit 851 may be provided to pressurize a lower portion of the protrusion inclined portion 8593.

It will be apparent to those skilled in the art that the present invention may be embodied in other specific forms without departing from the spirit and essential characteristics of the invention. Thus, the above embodiments are to be considered in all respects as illustrative and not restrictive. The scope of the invention should be determined by reasonable interpretation of the appended claims and all change which comes within the equivalent scope of the invention are included in the scope of the invention.

What is claimed:

1. A laundry treating apparatus, comprising:

a cabinet including a receiving space to receive laundry;

a door coupled to the cabinet, the door configured to open or close the receiving space;

a supply unit configured to supply at least one of air and water into the receiving space;

a laundry compress provided at an inner surface of the door, the laundry compress configured to rotate (1) around a rotation axis parallel to a width direction of the door, and (2) in a height direction of the door to compress the laundry, wherein the laundry compress comprises:

a compression unit provided to rotate in the height direction of the door to compress the laundry, a support unit provided to be contacted with the laundry between the compression unit and the door;

wherein the support unit comprises:

a support body provided to be contacted with the laundry that is compressed by the compression unit, an open space located in a center of the support body to separate the support body in the width direction of the door, and the open space is provided to avoid pressing a sewing line of the laundry.

2. The laundry treatment apparatus according to claim 1, wherein the laundry compressed by the laundry compress and the rotation axis are arranged in an overlapping manner when viewed from an orthogonal angle of the inner surface of the door.

3. The laundry treatment apparatus according to claim 1, wherein the laundry compress further comprises:

a link connected to the compression unit, the link configured to rotate the compression unit to adjust an interval between the compression unit and the inner surface of the door.

4. The laundry treatment apparatus according to claim 3, wherein the compression unit is spaced apart from the inner surface of the door by the link.

5. The laundry treatment apparatus according to claim 1, wherein a lower portion of the laundry compress is rotatably coupled with the door.

6. The laundry treatment apparatus according to claim 5, wherein the laundry compress rotates upwardly towards proximity with the inner surface of the door.

7. The laundry treatment apparatus according to claim 5, wherein the laundry compress comprises:

a compression unit contacting the laundry to compress the laundry; and a link connected to the compression unit, the link configured to rotate the compression unit to adjust an interval between the compression unit and the inner surface of the door.

8. The laundry treatment apparatus according to claim 7, wherein the link comprises:

a left link connected to one side of the compression unit; and a right link connected to the other side of the compression unit, wherein the one side and the other side are defined in a width direction of the compression unit.

9. The laundry treatment apparatus according to claim 1, further comprising:

a vertical axis rotation laundry compress provided at the inner surface of the door, the vertical axis rotation laundry compress configured to rotate (1) around a vertical rotation axis parallel to the height direction of the door, and (2) in a transverse direction of the door to compress the laundry.

10. The laundry treatment apparatus according to claim 9, wherein compressing the laundry by the laundry compress and pressing the laundry by the vertical axis rotation laundry compress are able to be performed together.

11. The laundry treatment apparatus according to claim 10, wherein the laundry compress is disposed lower than the vertical axis rotation laundry compress.

12. The laundry treatment apparatus according to claim 1, wherein the support body comprises:

a protruding surface provided on the inner surface of the door to contact the laundry, wherein the laundry is pressed between the protruding surface and the laundry compress.

* * * * *